US009676526B2

(12) United States Patent
Gonsalves et al.

(10) Patent No.: US 9,676,526 B2
(45) Date of Patent: Jun. 13, 2017

(54) CONTAINER AND METHOD FOR PRESERVING AIR-SENSITIVE MATERIALS

(71) Applicant: Forever Products LLC, Berkeley, CA (US)

(72) Inventors: Anthony J. Gonsalves, Berkeley, CA (US); Clive Solari, East Lindfield (AU)

(73) Assignee: FOREVER PRODUCTS LLC, Berkeley, CA (US)

( * ) Notice: Subject to any disclaimer, the term of this patent is extended or adjusted under 35 U.S.C. 154(b) by 0 days.

(21) Appl. No.: 14/853,988

(22) Filed: Sep. 14, 2015

(65) Prior Publication Data

US 2017/0073125 A1 Mar. 16, 2017

(51) Int. Cl.

| | |
|---|---|
| ***B65D 53/00*** | (2006.01) |
| ***F16L 55/132*** | (2006.01) |
| ***F16L 55/136*** | (2006.01) |
| ***B65D 39/00*** | (2006.01) |
| ***B65D 39/12*** | (2006.01) |
| ***B65D 81/24*** | (2006.01) |
| ***B65D 53/04*** | (2006.01) |
| ***B65D 39/02*** | (2006.01) |
| ***B65D 39/16*** | (2006.01) |
| ***B65D 43/02*** | (2006.01) |

(52) U.S. Cl.
CPC ..... *B65D 43/0233* (2013.01); *B65D 39/12* (2013.01); *B65D 81/245* (2013.01)

(58) Field of Classification Search
CPC .... B65D 39/00; B65D 39/12; B65D 39/0088; B65D 39/025; B65D 39/16; B65D 53/04; B65D 81/245; F16L 55/132; F16L 55/136
USPC ..... 220/235, 236, 237
See application file for complete search history.

(56) References Cited

U.S. PATENT DOCUMENTS

| | | | | |
|---|---|---|---|---|
| 340,409 A | | 4/1886 | Albaugh et al. | |
| 2,731,663 A | * | 1/1956 | Thompson | A47J 45/074 16/422 |
| 3,901,167 A | * | 8/1975 | Reese | E05G 1/026 109/64 |
| 4,401,228 A | * | 8/1983 | Baldelli | B65D 39/12 215/360 |
| 4,889,250 A | | 12/1989 | Beyer | |

(Continued)

FOREIGN PATENT DOCUMENTS

| | | |
|---|---|---|
| AU | 714132 B2 | 12/1999 |
| CN | 102001492 A | 4/2011 |

(Continued)

OTHER PUBLICATIONS

PCT/US2016/051753 International Search Report and Written Opinion dated Dec. 7, 2016, pp. 14.

*Primary Examiner* — Andrew T Kirsch
(74) *Attorney, Agent, or Firm* — Strategic Innovation IP Law Offices, P.C.

(57) ABSTRACT

Container for e.g. wine has a vessel, a seal assembly, and a handle assembly. The seal assembly has upper and lower seal compressor moldings on major faces of a seal, and seal's edge expands in response to moving the seal's major faces together to increase a diameter of the seal. Pressure on a glass vessel is sufficiently low to prevent the glass from cracking or breaking, and pressure can be sufficiently high to prevent air from entering the enclosed volume. Methods and parts associated with the container are also discussed.

23 Claims, 18 Drawing Sheets

(56) References Cited

U.S. PATENT DOCUMENTS

| | | | | |
|---|---|---|---|---|
| 4,975,028 | A | 12/1990 | Schultz | |
| 5,244,106 | A * | 9/1993 | Takacs | B65D 23/12 215/12.1 |
| 5,348,085 | A * | 9/1994 | Benson | E21B 33/03 166/92.1 |
| 6,053,366 | A | 4/2000 | Legué | |
| 6,105,803 | A | 8/2000 | Standish | |
| 7,726,356 | B2 | 6/2010 | van der Lande | |
| 8,403,166 | B2 * | 3/2013 | Steininger | B65D 43/022 220/235 |
| 8,607,832 | B2 | 12/2013 | Ferlito et al. | |
| 2008/0230144 | A1 | 9/2008 | Anderson | |
| 2011/0114592 | A1 | 5/2011 | Garrison | |
| 2011/0290826 | A1 | 12/2011 | Harris | |
| 2012/0125930 | A1 | 5/2012 | Arney | |

FOREIGN PATENT DOCUMENTS

| | | | |
|---|---|---|---|
| DE | 3619501 | A1 | 12/1987 |
| DE | 4310084 | A1 | 9/1994 |
| DE | 29822570 | U1 | 3/1999 |
| DE | 19858576 | A1 | 6/2000 |
| EP | 0135974 | A2 | 4/1985 |
| EP | 2269919 | A1 | 1/2011 |
| FR | 2638432 | A1 | 5/1990 |
| FR | 2992633 | A1 | 1/2014 |
| GB | 466198 | A | 5/1937 |
| JP | 2012090673 | A | 5/2012 |
| WO | WO2008/097566 | A1 | 8/2008 |
| WO | WO2010/124330 | A1 | 11/2010 |
| WO | WO2012/098366 | A1 | 7/2012 |

* cited by examiner

120

202
210

220
203

230
210

201

310

310

320
150
310

TOP VIEW

Seal Assembly

FRONT VIEW

BOTTOM VIEW
401
402
403
404
405
110

401

503
501
506A
506B
TOP VIEW 501
506A
504
503
506A
Seal 501
502
506B
503
FRONT VIEW

403

TOP VIEW

BOTTOM VIEW
Upper Seal Compressor

TOP VIEW

Lower Seal Compressor

FRONT VIEW

BOTTOM VIEW
402
701
702
703
704
705
706
707

TOP VIEW
804
806
807

FRONT VIEW
808
805
803
802

BOTTOM VIEW
807
805

Seal Compressor Screw
804
806
807
805
404

901
902
903
904
130
TOP VIEW
BOTTOM VIEW

901
TOP VIEW 901
1002
1001
903
FRONT VIEW 1002
1001
903
901
BOTTOM VIEW 901
1002
903
SIDE VIEW

1000

1100
1101
1102
UP VIEW 1102
1102

902
FRONT VIEW 1101
1102
902
BOTTOM VIEW 1301
1302
TOP VIEW
FRONT VIEW
BOTTOM VIEW
140

CONTAINER AND METHOD FOR PRESERVING AIR-SENSITIVE MATERIALS

BACKGROUND AND SUMMARY OF THE INVENTION

The problem of economically and effectively precluding air from entering beverages and foods during storage has been a problem that many have attempted to solve. People have used various systems such as mechanical seals, balloons, inert gases, vacuum, and floating seals in an attempt to improve storage life for such oxygen-sensitive materials. However, most such systems have been ineffective in providing acceptable performance, life, expense, simplicity, and/or aesthetic.

The invention discussed herein provides a new container and associated, new methods for isolating a material to be preserved from an ambient that acts on that material. In one embodiment discussed herein, the container and methods are well-suited to preserve wine or other oxygen-sensitive beverage once the beverage's original container has been opened.

In one instance, a container comprises a vessel and a seal assembly that expands to a state in which the seal of the seal assembly compresses against an inner wall of the vessel, yet retracts to have a maximum diameter that is less than the inner diameter of the vessel for easy insertion and positioning.

In one particular embodiment, the seal is squeezed longitudinally to cause the seal to expand radially and seal against an inner wall of a vessel. In another embodiment, the seal is attracted to the sidewall using magnetism, thereby compressing the seal against the sidewall.

In another instance, a container comprises a vessel and seal assembly in which the seal is housed in such manner that a seal compressor of the seal assembly expands a diameter of the seal.

The invention also provides various seal assemblies and handle assemblies as described herein.

Various methods associated with sealing a container are also provided. In one instance, a method of preserving a liquid from a contaminant involves positioning a seal assembly having an uncompressed seal at or slightly below a surface of the liquid, and compressing an edge of the seal sufficiently against an inner surface of the vessel to seal the liquid from the vessel's surrounding ambient.

In another instance, a method comprises applying a pressure to a seal, where the seal has major faces and an edge extending between the major faces, and where the pressure is applied to the major faces; and expanding the seal primarily in a direction normal to the major faces in response to said pressure and with sufficient force to compress the edge of the seal against an inner wall of a vessel.

These and other containers, methods, and parts are apparent from the discussion herein.

BRIEF DESCRIPTION OF THE DRAWINGS

FIG. 1B illustrates a handle/seal assembly positioned at or slightly beneath a liquid surface prior to compressing the seal against the transparent vessel's inner wall.

DESCRIPTION OF CONTAINER FOR AIR-SENSITIVE MATERIALS

The attached figures illustrate particular containers for wine or other beverage or material that is air-sensitive. The following discussion provides details of various pieces associated with the container as well as a description of how the pieces interact.

Figure 1A:
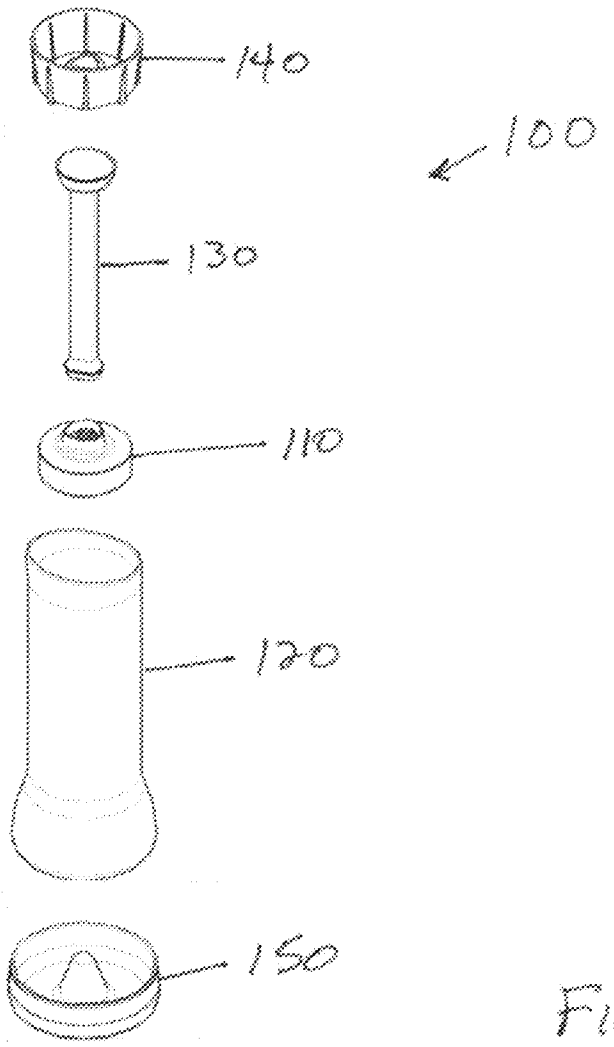
FIG. 1A is an exploded view of a first container.

As illustrated by FIG. 1A and FIG. 1B, one particular container 100 has a seal assembly 110 and a vessel 120. The container depicted in FIG. 1 also has an optional removable handle assembly 130 that engages with the seal assembly. Also depicted in FIG. 1 are an optional cap 140 and optional base 150.

Referring to FIG. 1B, a user who has placed liquid 160 within vessel 120 for preservation assembles the optionally-removable handle assembly 130 to the cap 140 and to seal assembly 110. The user then inserts the combined handle/seal assembly into the open mouth of the vessel 120 and positions the seal assembly at or slightly below the surface 161 of the liquid to be preserved. The user also pushes cap 140 into the open mouth of vessel 120 with an interference fit so that the cap does not rotate as knob 131 and an inner shaft of the handle assembly are rotated. (The inner and outer shafts of the handle assembly are not depicted in FIG. 1B for sake of clarity but are illustrated and explained in greater detail below.) The cap prevents rotation of an outer shaft of the handle assembly, described more fully below, so that the user does not have to manually grasp and hold the handle assembly's outer shaft stationary as the assembly's knob and inner shaft are rotated. The cap also aids in keeping the seal assembly level and therefore parallel to the surface 161 of the liquid 160. The user turns the knob 131 on the end of handle assembly 130 to rotate the inner shaft positioned within the handle assembly. The shaft's rotation expands the seal 111 and compresses it against the vessel's inner wall, sealing the liquid from surrounding air, while the outer portion of the handle assembly prevents much of the seal assembly from rotating as the inner shaft rotates. The user can, if desired, remove the handle assembly 130 from the seal assembly 110 where the handle assembly is not integral with the seal assembly until the user requires the liquid within the container. At that time, the user reverses the procedure above by reassembling the handle assembly 130 to the seal assembly 110, turning knob 131 in the opposite direction to retract the seal to its resting position within the seal assembly, and then removing the handle/seal assembly from the vessel to access the vessel's contents 160.

The following text explains various parts used to make a container. Specific examples of those parts are then explained in greater detail.

Vessel

Figures 2A, 2B, 2C, 2D:
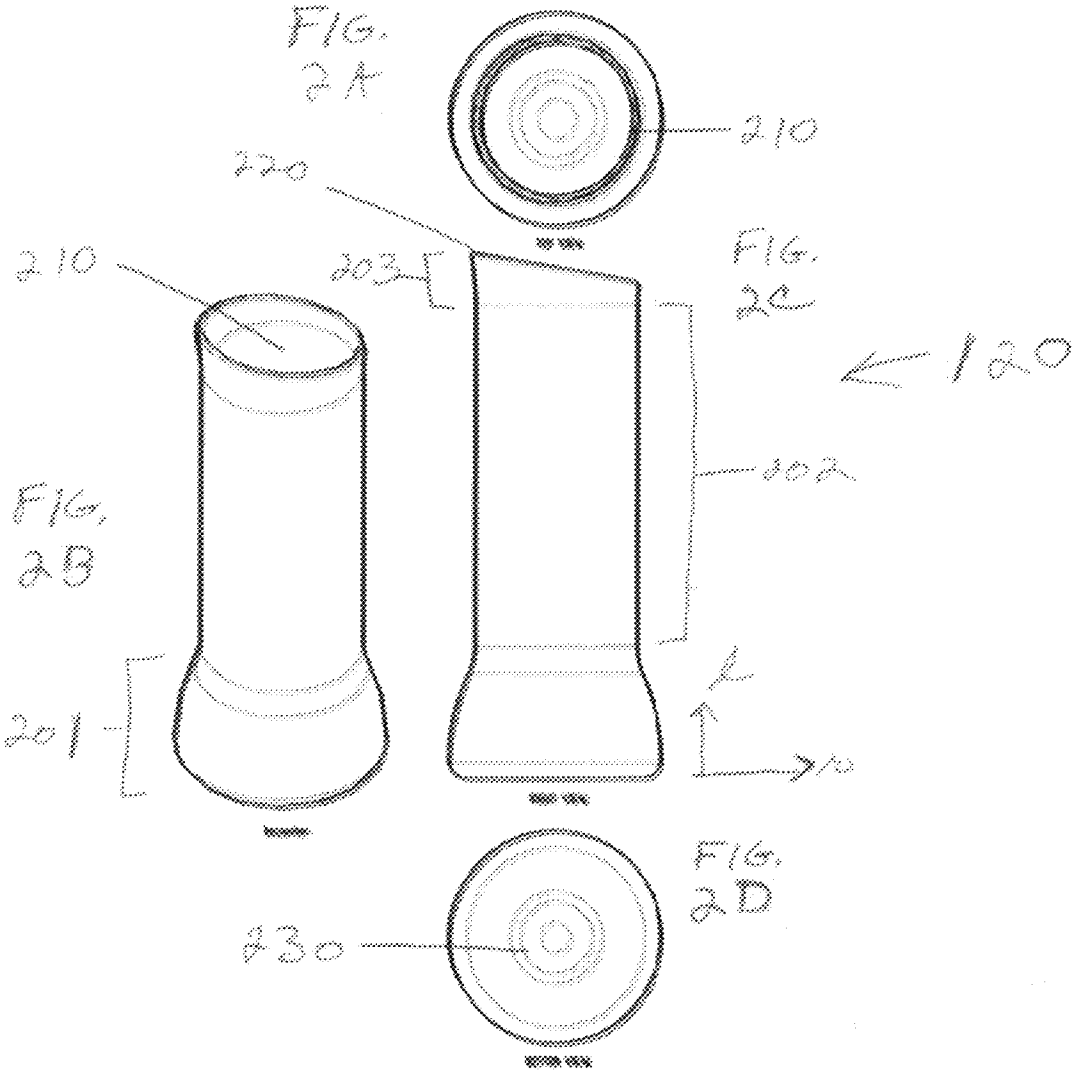
FIG. 2 provides top (2A), perspective (2B), side (2C), and bottom (2D) views of a vessel.

FIG. 2 illustrates one vessel 200 that is generally cylindrical. The inner wall of a cylindrical vessel as the term is used herein may have different radii along the vessel's length as long as the seal assembly can form an air-tight closure against the inner sidewall over at least a majority of the vessel's inner wall. The wall thickness and shape may vary along the vessel's length so that the outer surface of the vessel can have any of many shapes, from having a generally cylindrical appearance to having curved outer walls that taper inward toward the vessel's center or upper portion to allow a person to grasp the vessel more easily, for instance.

The vessel may be tapered along part or along all of its inner wall. The vessel illustrated in FIG. 2 has a portion 201 in which its inner wall 210 has a taper of decreasing radius r along the vessel's length 1 in a lower portion of the decanter (using the decanter's bottom upon which the decanter rests as the origin for measurement of length).

A second portion 202 of the vessel illustrated in FIG. 2 is strictly cylindrical, and the volume defined by its inner wall conforms to the formula $V=\pi^2L$, where r is the radius to the cylindrical portion's inner wall and L is the cylindrical portion's length. The seal assembly easily engages the vessel's inner wall in this cylindrical portion so that the seal has air-tight engagement along a majority of the vessel's inner wall.

A third portion 203 of the vessel toward the top of the vessel has a slight taper that increases along the vessel's length. This tapered portion enables easier insertion of the seal assembly into the vessel. This third portion also provides a lip or spout 220.

The vessel can be formed of any material suitable for the contents to be stored in the vessel. The vessel may be transparent, translucent, opaque, or a combination of these in various regions across the vessel's height and around its circumference. The vessel may be formed of an organic polymer such as acrylonitrile-butadiene-styrene copolymer, poly(methyl methacrylate), polycarbonate, an amorphous blend of poly(phenylene ether) and polystyrene, or other polymer. The vessel may be formed of an inorganic material such as silica glass, polycrystalline ceramic, glass-ceramic, or other material.

The vessel may be a decanter suitable for containing a liquid such as wine, fruit juice, water, or milk that is oxygen-sensitive or that absorbs odors from air. Any of the features discussed herein in conjunction with particular decanters may apply to vessels in general, alone or in any combination of those features.

Figure 16:
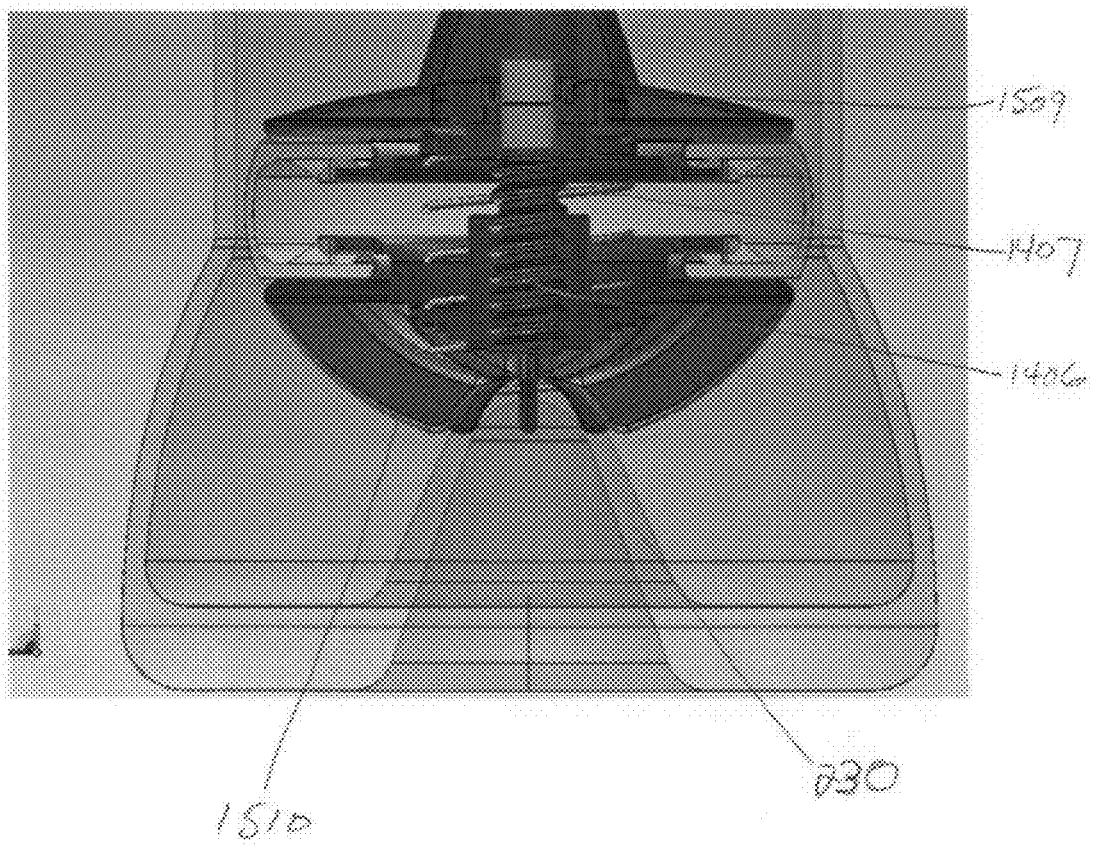
FIG. 16 is a phantom view of the seal assembly of FIG. 15 within a vessel.

The particular decanter illustrated in FIG. 2 is flared at its base or first portion 201 so that its outer wall is also tapered, and the decanter has an optional indentation or punt 230 in the decanter's base portion. The punt enables a person to insert the person's thumb or other fingers into the punt's depression while gripping an outer portion of the decanter's base portion with other fingers to pour contents out of the decanter's chamber. The punt in this particular decanter also acts as a stop or rest for the seal assembly to prevent the seal assembly from moving so close to the decanter's base that the seal fails to engage with the decanter's inner wall, as illustrated in FIG. 16.

Figures 3A, 3B, 3C, 3D:
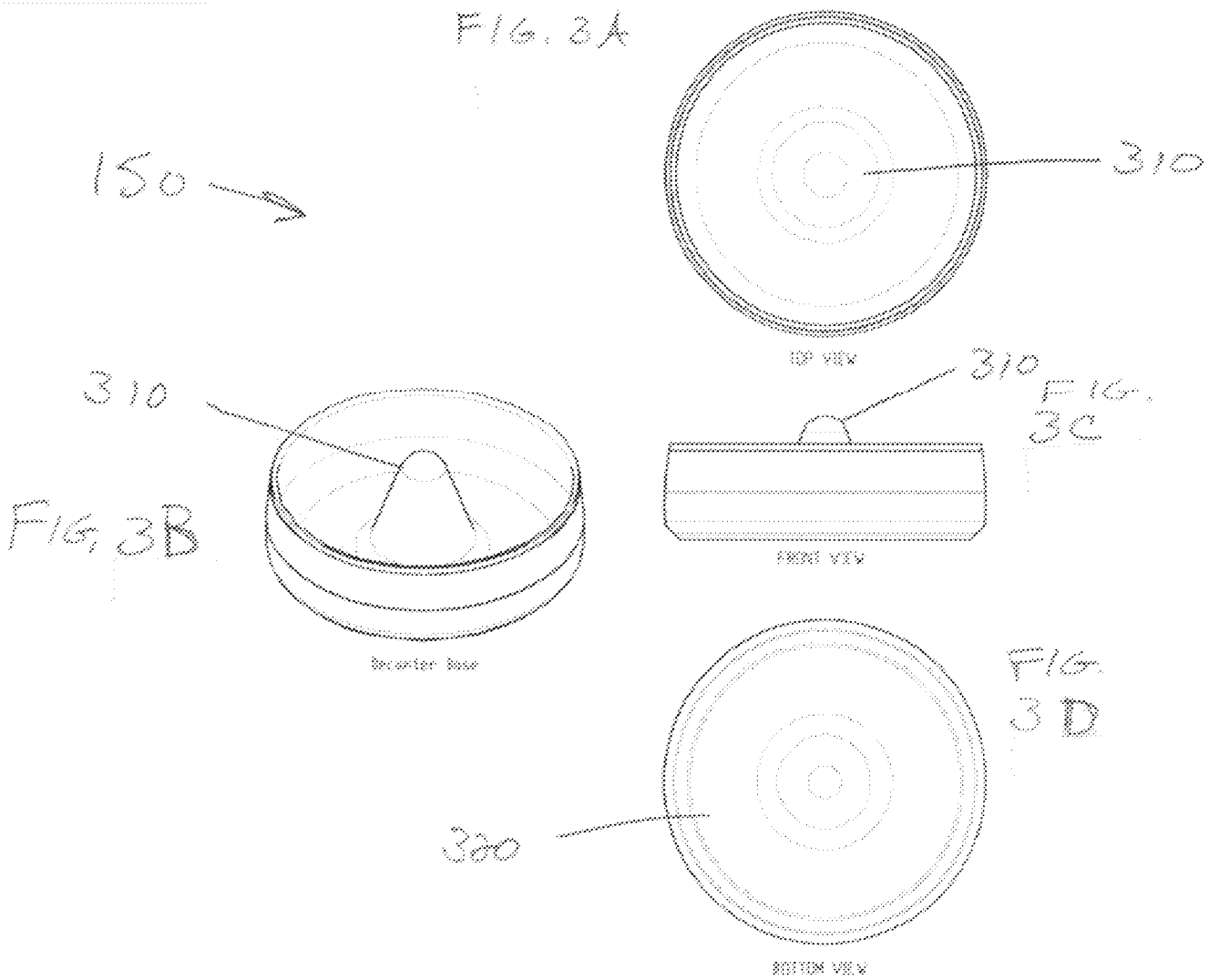
FIG. 3 provides top (3A), perspective (3B), side (3C), and bottom (3D) views of an optional base for the container.

As shown in FIG. 1 and FIG. 3, the decanter may also have a separate base 150 that engages the decanter. The base may be secured to the decanter such that it is necessary to deform or destroy the base to remove it from the decanter. The base may alternatively be easily separated from the decanter to provide a convenient rest for the decanter. The base in either instance may have a tapered center portion 310 that engages with the punt in the decanter's base to provide stability to the decanter when it is assembled to its base. Further stability can be added by providing e.g. a rubber or cork film 320 along an edge of the bottom or along the entire bottom of base 150. The decanter may of course be provided with or without punt and with or without base in each of these instances.

Seal Assembly

Figures 4A, 4B, 4C, 4D:
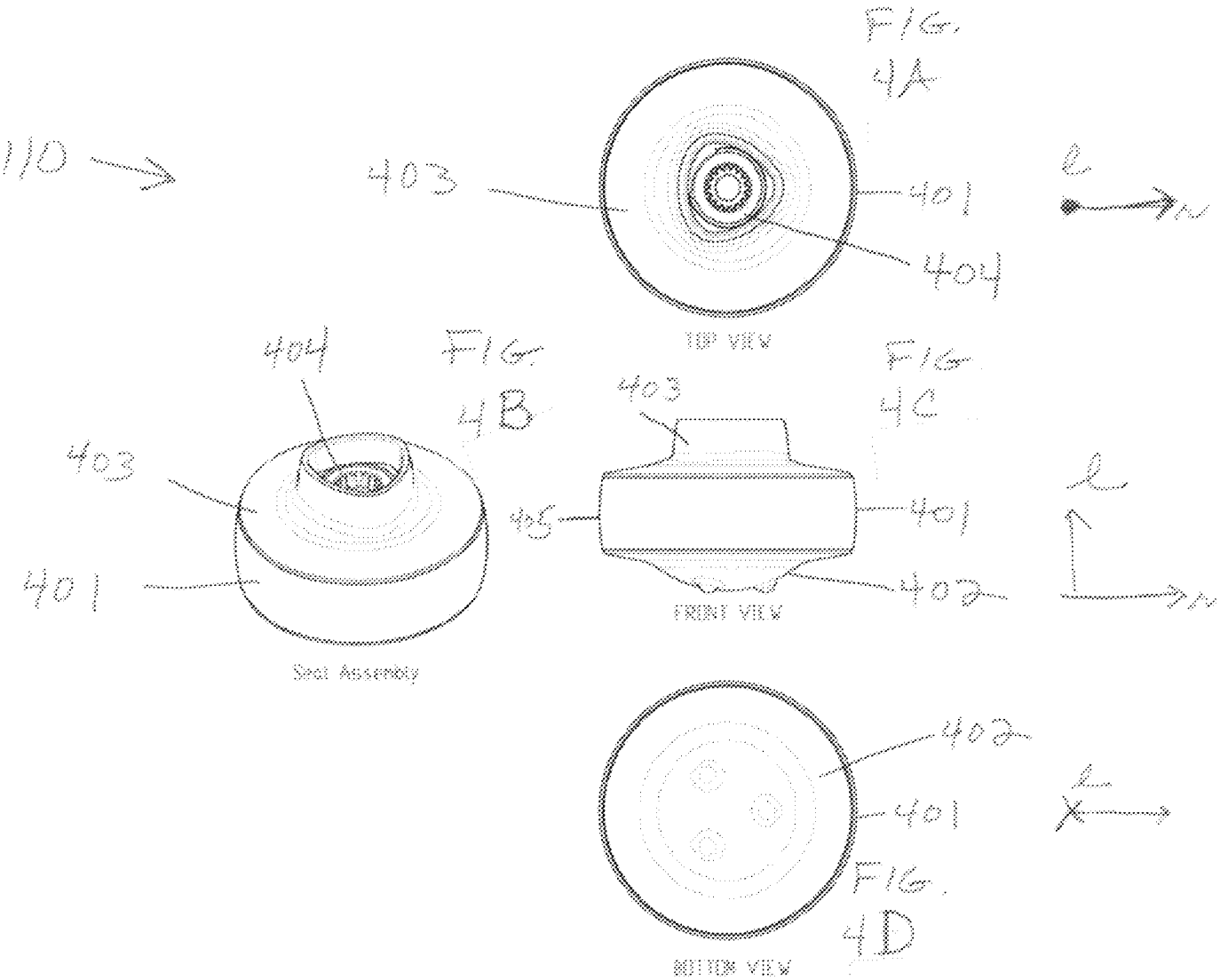
FIG. 4 depicts top (4A), perspective (4B), side (4C), and bottom (4D) views of an illustrative seal assembly.

FIG. 1 and FIG. 4 illustrate a particular seal assembly 110. The seal assembly 110 has a resilient seal 401, a lower seal compressor molding or platform 402, an upper seal compressor molding or platform 403, a screw or other compressor 404 that engages with the lower seal compressor molding 402 as well as the upper seal compressor molding 403 to change the position of one of the seal compressor moldings relative to the other of the seal compressor moldings, and optionally a spring or other resilient separator (see e.g. FIG. 14 feature 1407) configured to push against the upper and lower seal compressor moldings to apply tension to sidewalls of the resilient seal. Because the seal assembly is formed of multiple parts, the seal assembly may have many diameters depending upon where along the seal assembly's length the diameter is measured. The maximum uncompressed diameter of the seal assembly is typically the diameter measured at the midpoint 405 of the seal's length along the seal's axis, since a C-shaped or U-shaped seal often has a bulge across its face as illustrated in FIG. 4. The seal assembly and its components are first discussed generally, and subsequently particular features of the first and second seal assemblies depicted in the figures are discussed.

Figures 5A, 5B, 5C:
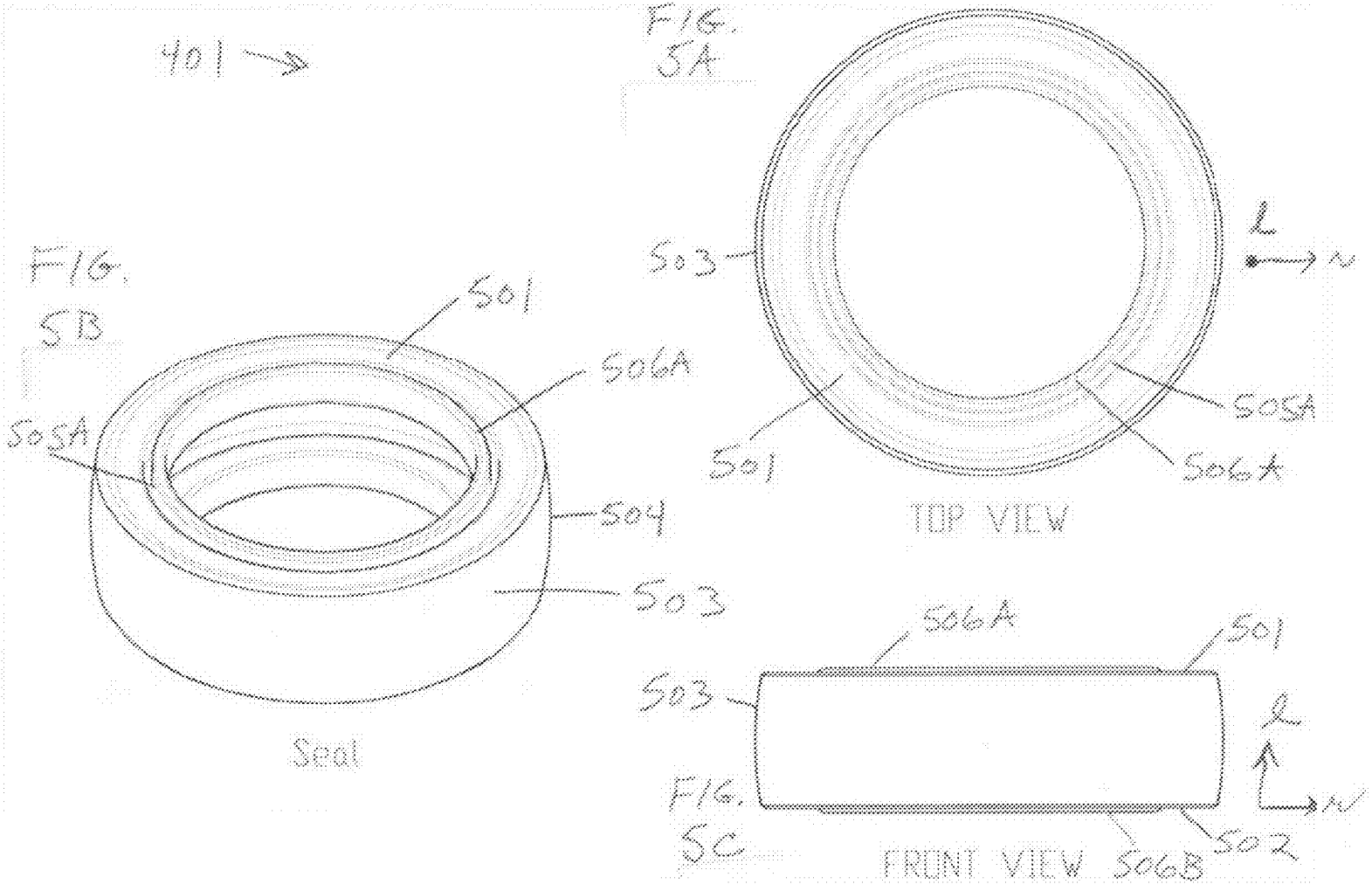
FIG. 5 illustrates top (5A), perspective (5B), and side (5C) views of a seal of the seal assembly shown in FIG. 4. The bottom view in this instance is identical to the top view and has not been repeated.

Referring to the particular seal illustrated in FIG. 4 and FIG. 5, the resilient seal 401 may have a shape such that the seal has upper major face 501, lower major face 502, and an edge 503 extending between the two major faces. The seal in one instance may have a shape that is much like a doughnut that has been hollowed out radially from the origin of the doughnut's radius. In another instance as shown in FIG. 5 or in FIGS. 15 and 16, a seal has a generally "C"- or "U"-shaped cross-section when the seal is viewed in a section cut across the seal's length. Each of a hollow seal's faces as well as the seal's sidewall have interior and exterior portions. The upper and lower annular major faces are optionally parallel to one another when the seal is in its free state (not assembled to other pieces such as the upper and lower seal compressor moldings).

The seal's exterior sidewall portion 504 engages the interior sidewall of the vessel during use. The seal's sidewall preferably bulges slightly outward, in a direction away from the seal's center axis, when the seal is in its free state as depicted in FIG. 5 and/or when part of a complete seal assembly as shown in FIG. 4.

The seal 401 has a slight bulge so that the seal can expand (i.e. increase its diameter) over a larger range of expansion as the seal is compressed as compared to a seal that lacks the bulge. The bulge permits the seal to engage a wider range of vessel diameters and also provide a wider range in surface area of the seal that engages the inner sidewall of the vessel to seal the enclosed vessel volume. A larger area of seal pressing against the sidewall enables the seal to remain stationary and not move vertically to retain a gas under pressure (such as carbonation within a liquid in the vessel) within the enclosed volume in the vessel, thereby retaining more of the gas in its dissolved state in the liquid.

The seal 401 of FIG. 4 may also be sufficiently resilient that the seal assembly 110 does not require a resilient separator such as coil spring 1407 of FIG. 14 (discussed in more detail below) to restore the seal sufficiently to disengage the seal from the vessel's inner sidewall. The seal's resilience allows the seal to retract sufficiently as the user releases sealing pressure in the seal assembly by separating platforms 402 and 403, thereby disengaging the seal from the vessel's inner sidewall.

The seal's sidewall may have a large but non-infinite radius of curvature as well as a relatively tall height. For instance, one particular seal 401 in its free state (in which the seal is not part of a seal assembly) may have a maximum resting diameter as measured at the widest bulge of about 63 mm or about 2.5 inches, and the seal's sidewall may be about 18.4 mm (about ¾ inch) tall as measured vertically at the tallest portion of the seal's face. A comparative "O"-ring seal has a small radius of curvature and typically very little vertical height. While an "O"-ring may be suitable for use in various embodiments of the invention, a seal having a much larger radius of curvature is preferred. When assembled to seal compressor platforms, the particular example of seal 401 discussed above as being used in the invention may have a diameter of about 67 mm or about 2⅝ inches. The seal's tall sidewall and large, non-infinite radius of curvature permits the seal to both expand sufficiently and apply a large enough area of the seal's surface to the vessel's inner sidewall that the seal can effectively seal against a vessel that has an inner diameter between about 69 mm (about 2 11/16 inches) and about 72 mm (about 2 53/64 inches). The seal is also sufficiently resilient that the seal's edge engages the inner sidewall of the vessel over a range of diameters. A silicone polymer or one with similar residency can be used for seal 401, for instance.

The seal may also have ribs, grooves, hooked portions, and/or other securing features on interior and/or exterior portions of the seal's faces, extending in a radial direction or extending along a constant radius around the seal as discussed in more detail later. The securing features engage with cutouts, ribs, notches, hooks, depressions, grooves, or other complementary securing features in the seal compressor moldings as discussed below.

The seal may be polymeric and may be made by e.g. injection molding. Consequently, the upper and lower faces, sidewall, securing features, and mating rings may all be formed of the same polymer. Suitable polymers include elastomers such as silicone, isoprene rubber, polybutadiene, butyl rubber, and other resilient polymers that are compatible with the beverage or other material that is to be stored in the container.

Seal Compressor Platforms

Figures 6A, 6B, 6C, 6D:
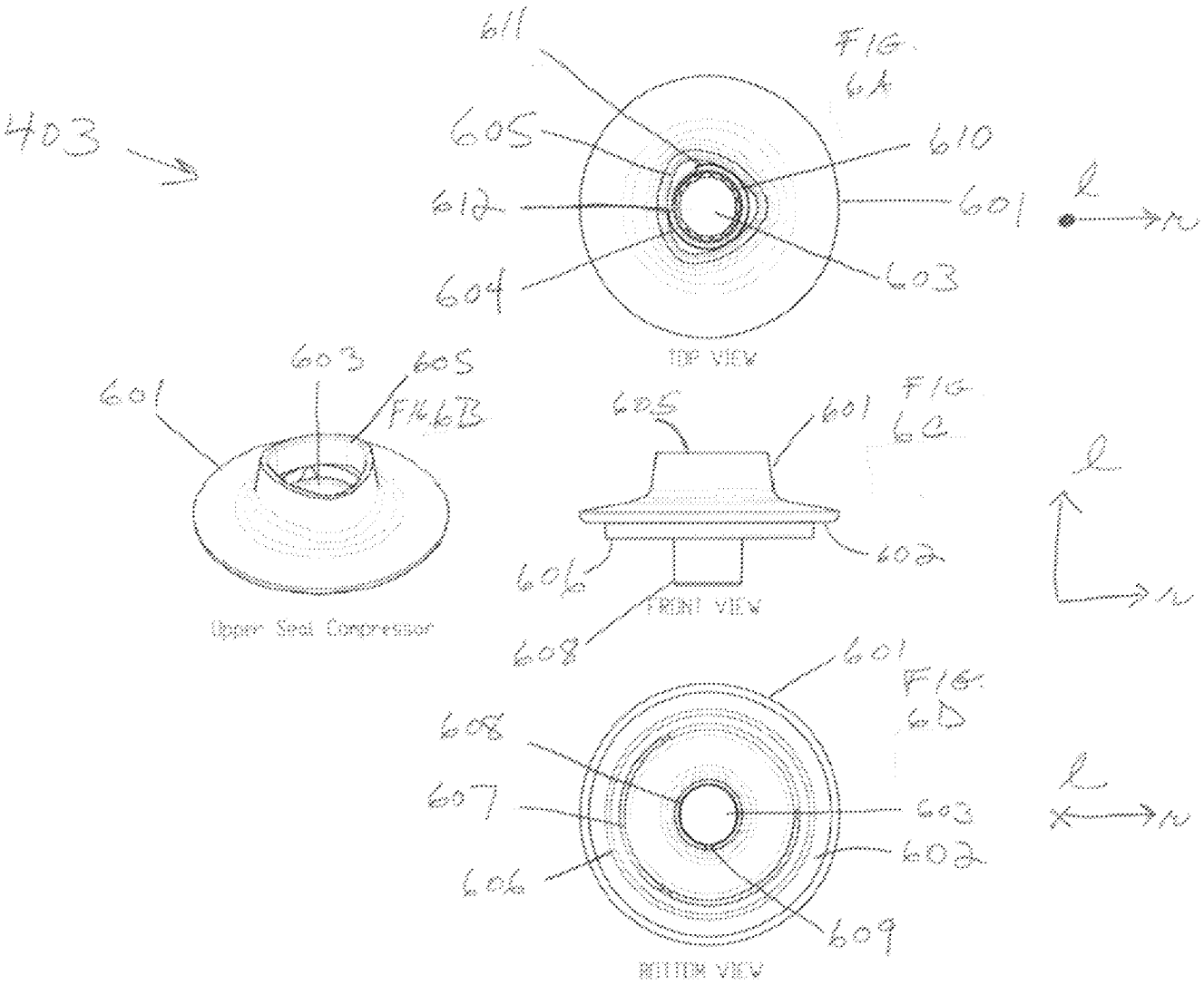
FIG. 6 depicts top (6A), perspective (6B), side (6C), and bottom (6D) views of an upper seal compressor part of the seal assembly of FIG. 4.
Figures 7A, 7B, 7C, 7D:
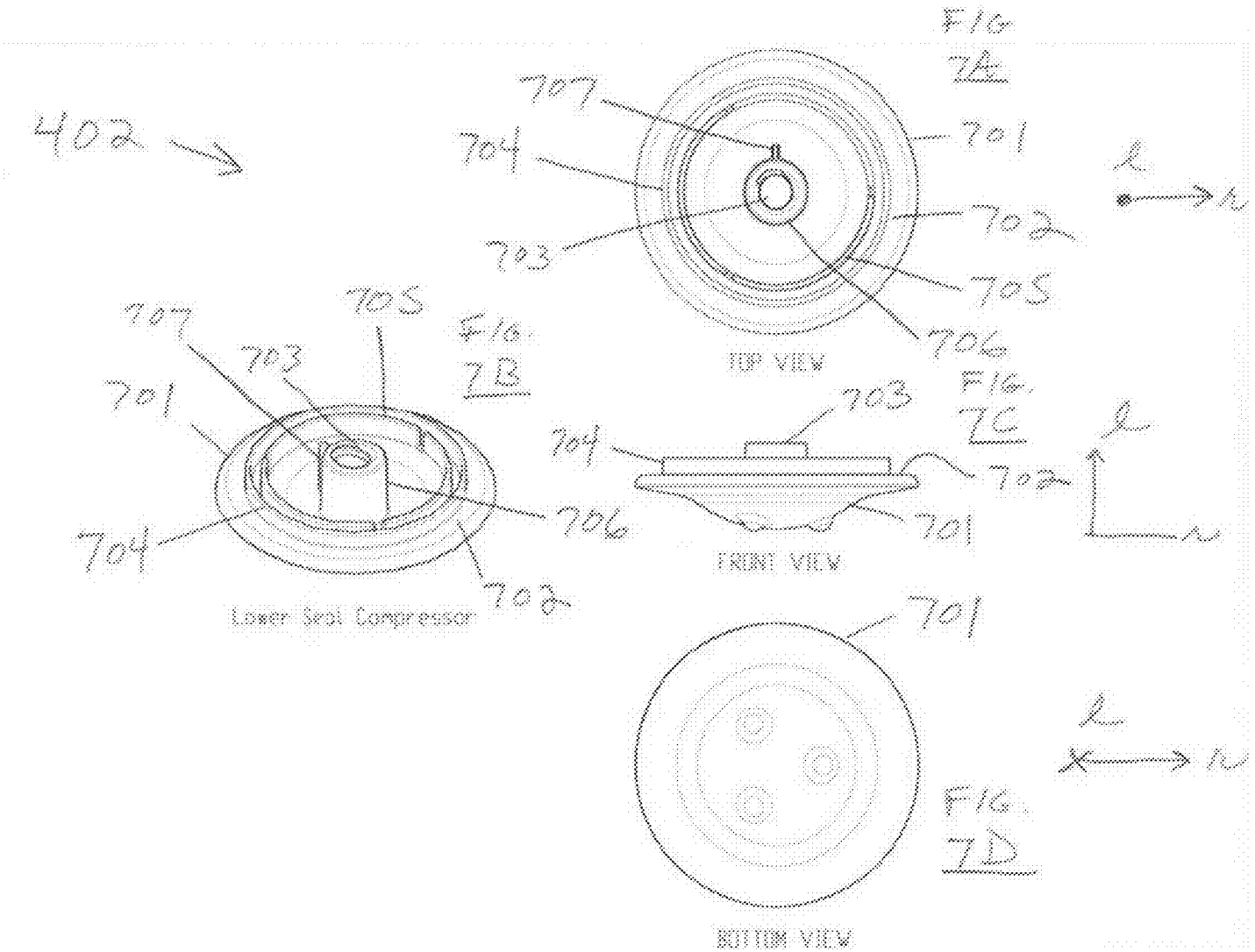
FIG. 7 depicts top (7A), perspective (7B), side (7C), and bottom (7D) views of a lower seal compressor part of the seal assembly of FIG. 4.

The seal compressor platforms or moldings 402 and 403 of FIG. 4, FIG. 6, and FIG. 7 each have a body (upper seal body 601, lower seal body 701) with annular faces (upper seal compressor molding annular face 602, lower seal compressor molding annular face 702) that engage exterior portions of the seal's major faces 501, 502 of FIG. 5. The seal compressor molding faces may be parallel to one another (in a "flat" configuration).

The upper seal compressor molding's body has, in addition to the features discussed above for each body, a central opening 603 of FIG. 6 through which a compressor such as a screw (confer FIG. 8) is inserted. The central opening may have a recessed portion that provides a platform on which the screw head pushes during use.

The upper seal compressor molding may have one or more openings 604 through its body 601 of FIG. 6 so that fluid (e.g. air) on one side of a molding may communicate with fluid (e.g. air) on the opposite side of that molding. Alternatively, the body of either or each seal compressor molding may be continuous so that there is no opening or discontinuity through the body that allows fluid on one side of a molding to communicate with fluid on the opposite side of that molding.

Referring to FIG. 7, the body 701 of the lower seal compressor molding 402 may have a portion 703 that engages with a compressor, as discussed below. For instance, the body 701 may have a threaded portion 03 which mates with a screw.

The seal's maximum exterior diameter when assembled to the upper and lower seal compressor moldings is preferably slightly less than or about the same as the interior diameter of the vessel (e.g. decanter) when the upper and lower seal compressor moldings are extended away from one another so that the seal assembly can be inserted into and positioned within the decanter's open volume easily.

The seal compressor moldings may be formed of a polymer or a metal or other material that has sufficient rigidity to apply force to the seal to cause its edge to extend. The seal compressor moldings may be formed by e.g. injection molding the pieces.

Compressor

The compressor (e.g. screw 404 of FIG. 8) has a first portion 802 that engages with the lower seal compressor molding's body and a second portion 803 that engages with the upper seal compressor molding's body. The compressor enables the user to adjust the spacing between the lower seal compressor molding's face and the upper seal compressor molding's face to apply a force to or release a force from the resilient seal of the seal assembly.

Figures 8A, 8B, 8C, 8D:
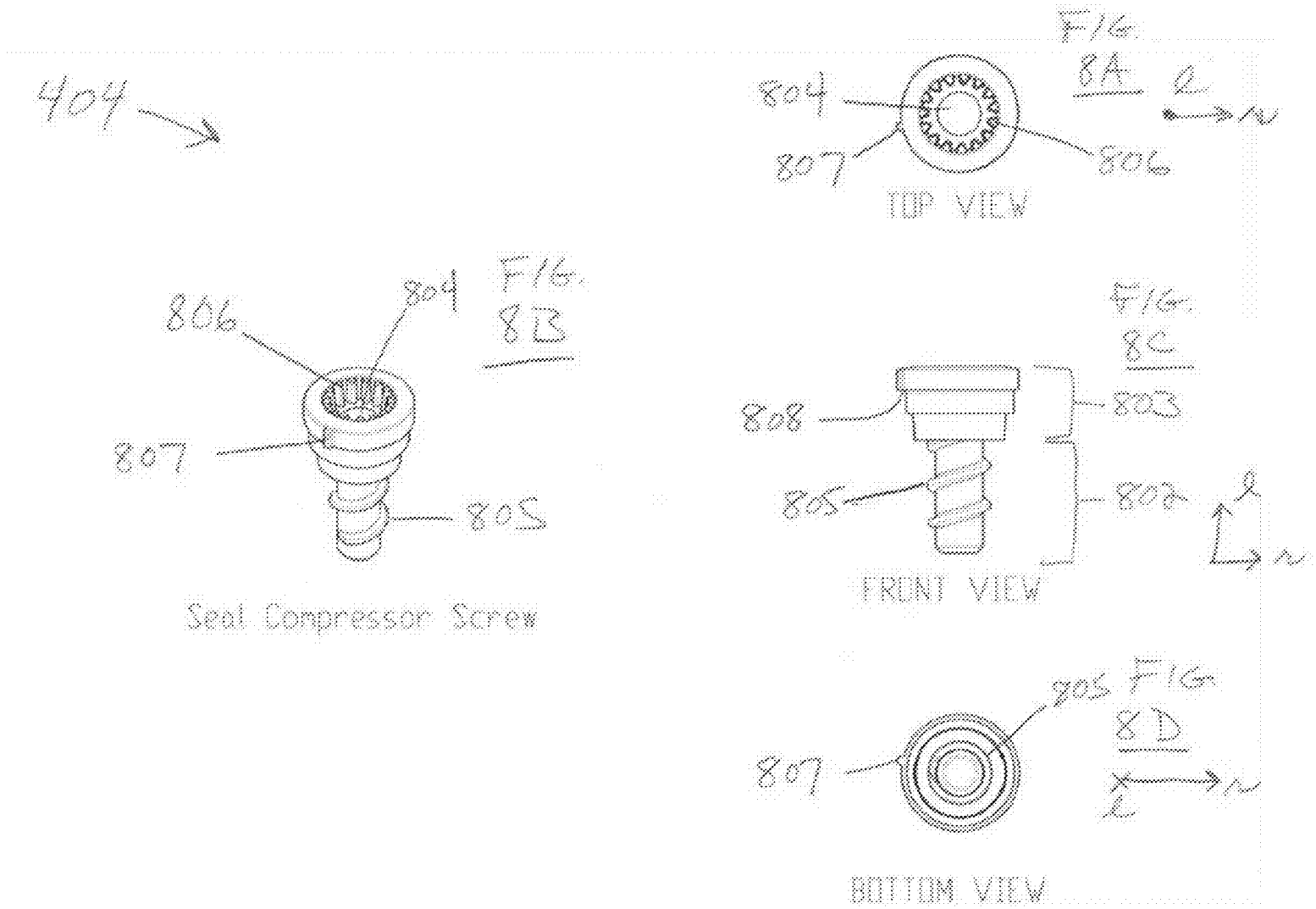
FIG. 8 illustrates top (8A), perspective (8B), side (8C), and bottom (8D) views of a compressor part of the seal assembly of FIG. 4.

In one instance, the compressor is a screw 404 as depicted in FIG. 8. The screw's threads engage threads of the lower seal compressor molding's threaded portion, and the screw's head engages the recessed portion of the central opening of the upper seal compressor molding.

The compressor may optionally have a magnet 804 or be e.g. metal that is attracted by a magnet in at least a portion 803 of the compressor that is close to the removable handle assembly.

The compressor may have one or more passages that allow air or other fluid to pass between the chambers formed by the upper and lower seal compressor moldings' bodies and the resilient seal.

The screw can be adjusted so that the upper seal compressor molding's face and lower seal compressor molding's face move toward one another. This action squeezes upper and lower faces of the resilient polymeric seal, forcing the seal's two faces to move closer to one another and thereby causing the seal's sidewall to bulge and increase the seal's diameter if the seal does not encounter an impediment such as the decanter's inner wall.

The compressor 404 also has ribs, slot, or cutouts 806 that engage with the distal end of the inner handle, as explained below. The shape and size of these features are selected to withstand the torque required to compress and release the seal assembly over thousands of uses.

The compressor may be formed of any material suited to the particular fluid stored in the container and the ambient around the container. The compressor may be metal and/or polymeric (e.g. nylon, polyethylene, polypropylene) and may be formed of the same polymer or a different polymer used to form the upper and lower seal compressor moldings. The compressor may be a molded part.

Handle Assembly

A handle assembly has a grip such as a knob, handle, lever, or other convenient feature that can be used when positioning the seal assembly within the vessel as well as when expanding or contracting the seal. The handle assembly, with its corresponding seal assembly engaged at the distal end of the handle assembly, can move as a unit along the longitudinal direction of the vessel. This configuration allows the seal assembly to be positioned within or removed from the vessel.

Figures 9A, 9B, 9C, 9D:
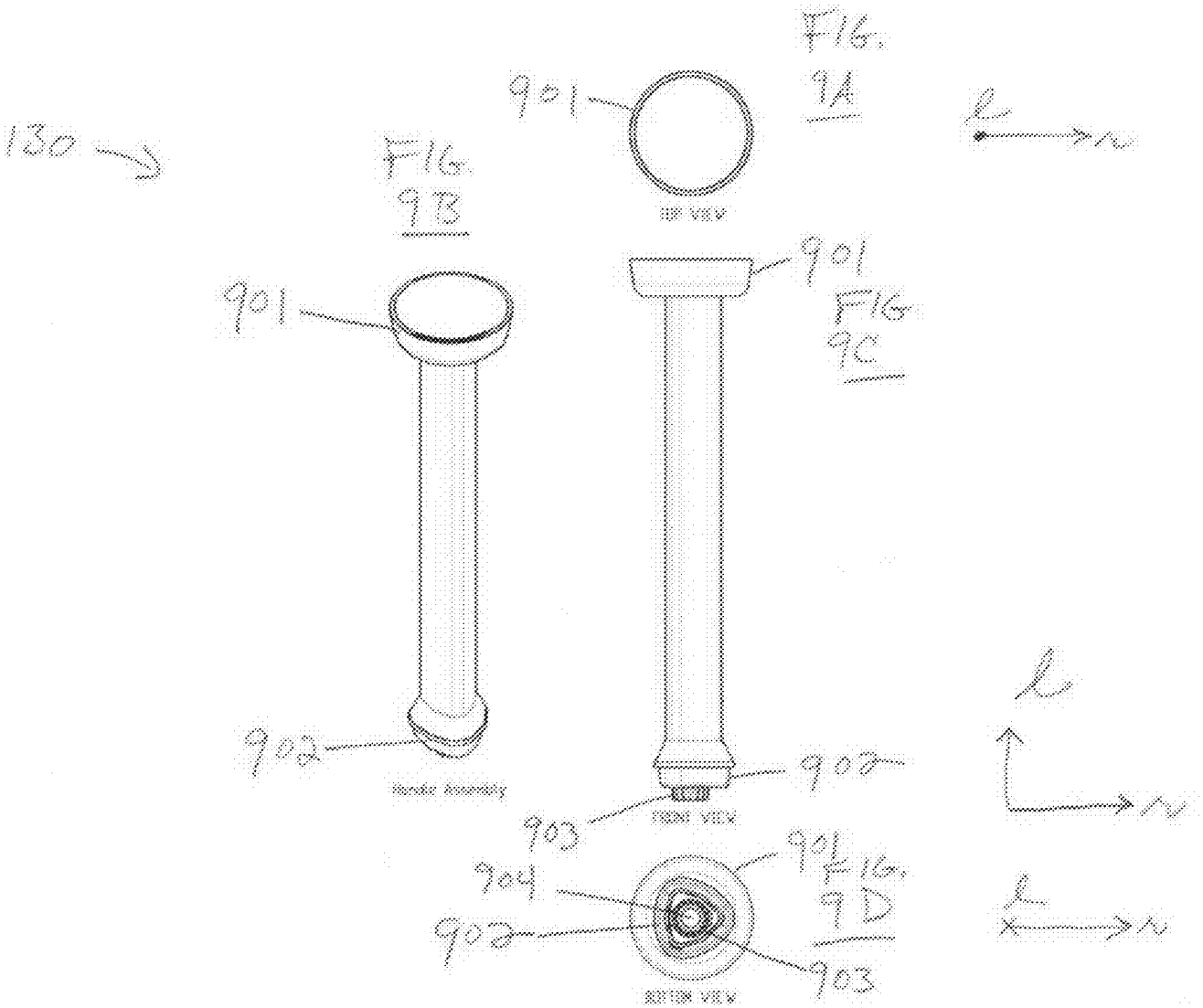
FIG. 9 depicts top (9A), perspective (9B), side (9C), and bottom (9D) views of a particular handle assembly used in conjunction with the seal assembly of FIG. 4.

FIG. 9 depicts a handle assembly 130 having a knob 901 to compress the seal or release compression. The handle assembly mates with the seal assembly to provide a convenient mechanism to expand or contract the seal. This handle assembly has a first portion 902 at its distal end that engages the upper seal compressor molding at form 605 and a second portion 903 that engages complementary features 806 of the compressor.

A first portion of the handle assembly may move relative to a second portion of the handle assembly to move the upper and lower seal compressor moldings to expand or contract the seal.

Figures 10A, 10B, 10C, 10D:
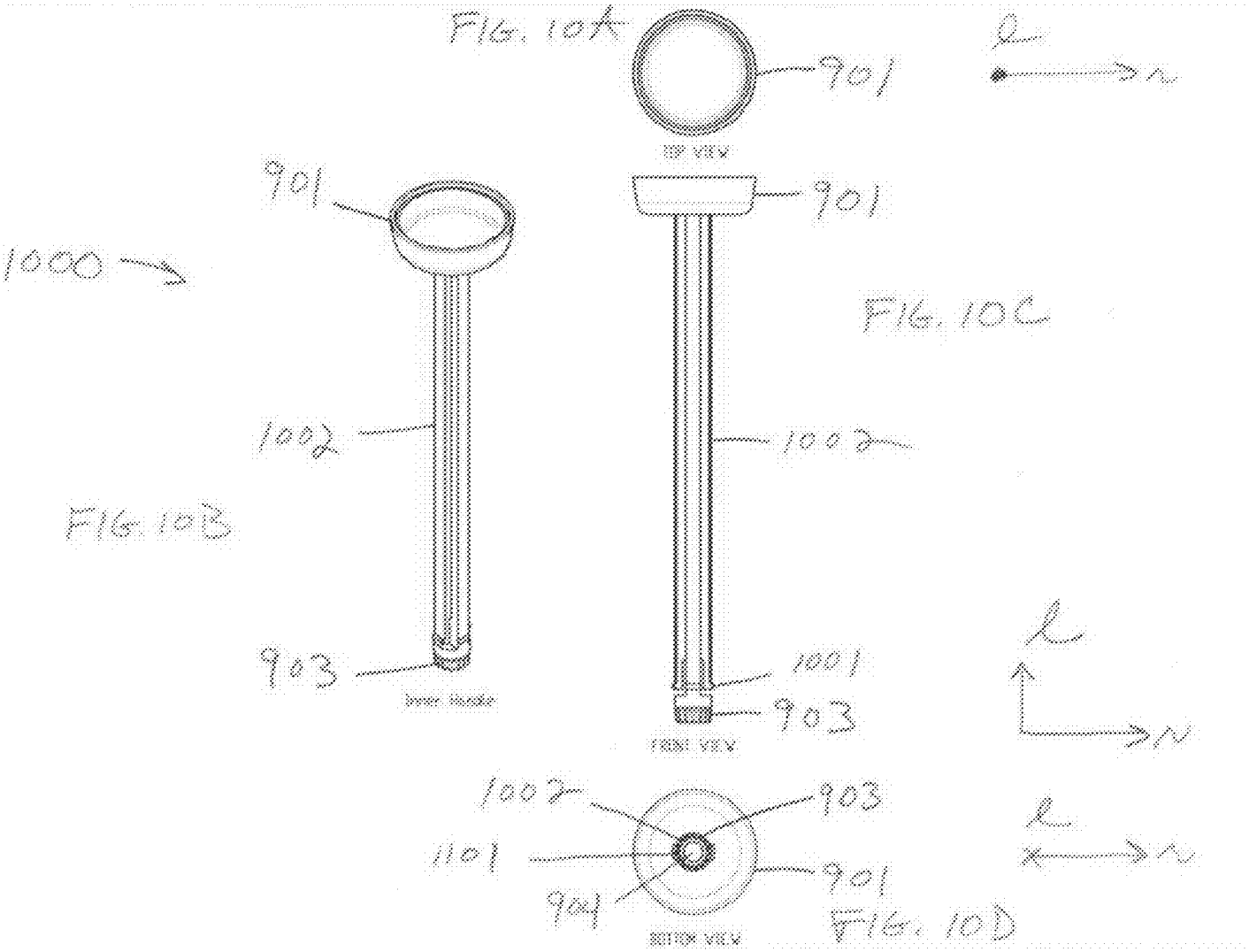
FIG. 10 depicts top (10A), perspective (10B), side (10C), and bottom (10D) views of an inner handle portion of the handle assembly depicted in FIG. 9.
Figures 11A, 11B, 11C, 11D:
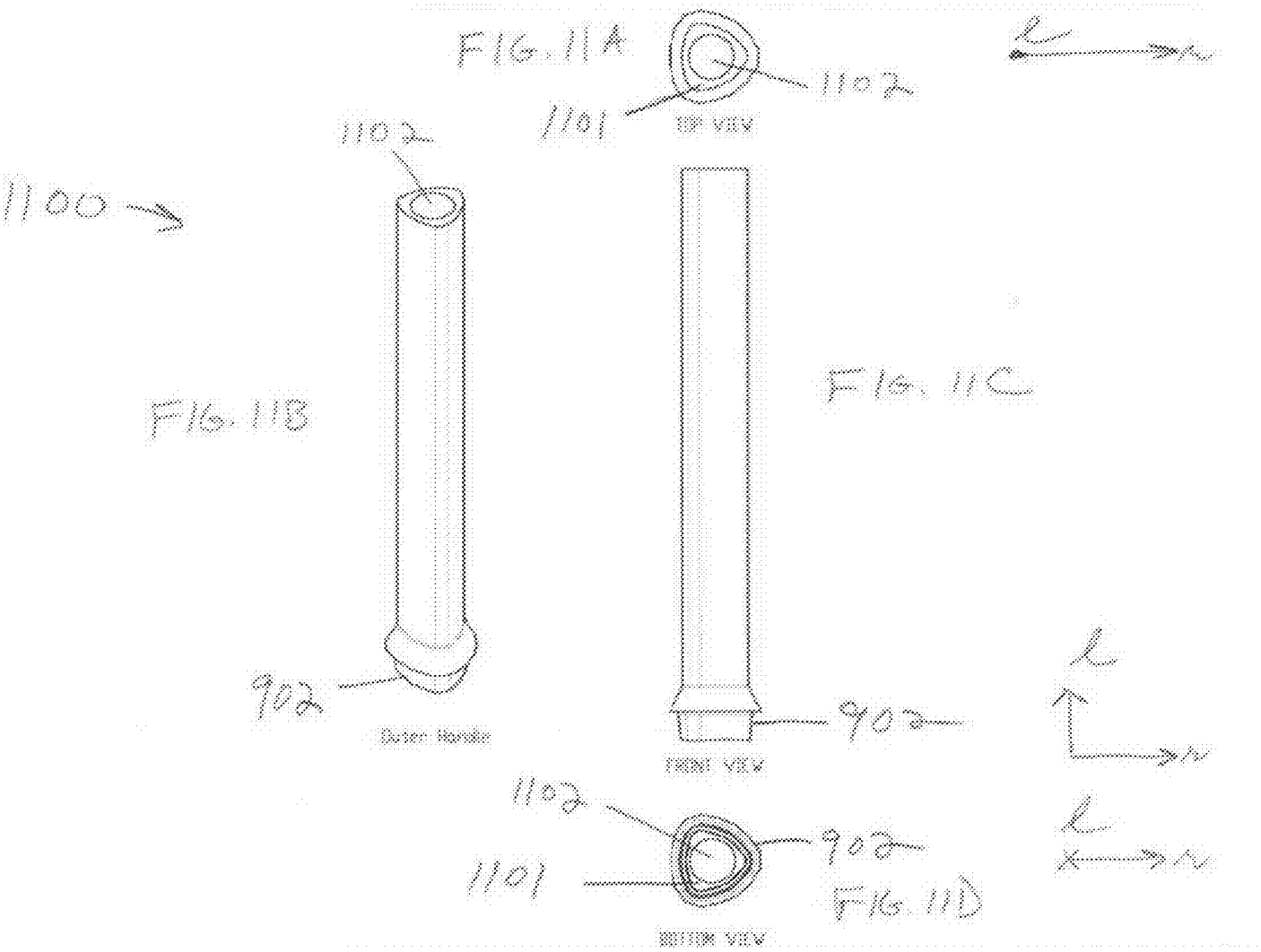
FIG. 11 depicts top (11A), perspective (11B), side (11C), and bottom (11D) views of an outer handle portion of the handle assembly depicted in FIG. 9.

In one instance, the handle assembly of FIG. 9 has an inner handle portion 1000 of FIG. 10 which extends through a channel or cavity 1102 through outer handle portion 1100 of FIG. 11 so that the inner handle portion and the outer handle portion can rotate relative to one another. Either or both of the inner and outer handle portions may rotate.

As an alternative, the movement of one portion relative to the other portion may be linear along the length of the handle assembly such that one portion moves longitudinally relative to the other portion. The grip therefore provides linear movement to one or both portions to move inner and outer portions and thereby move the upper and lower seal compressor moldings relative to one another.

The handle assembly is optionally removable from the seal assembly and can be held to one another by e.g. a magnet 904 in the handle assembly and a corresponding magnet or piece of metal attracted by magnetism in the seal assembly, as discussed above.

Optional Resilient Separator

The resilient separator provides sufficient force to the upper and lower seal compressor moldings to push them away from one another as the user adjusts the compressor to release compression force. The resilient separator may be formed of e.g. a metal, coated metal, or polymer that is compatible with the beverage in the decanter.

The resilient separator may be a spring, for instance, such as a coil spring, leaf spring, cylindrical accordion spring, or torque tube spring. The spring may be a constant rate spring or a rising rate spring. The resilient separator may instead or additionally be a block of polymer positioned between the upper and lower seal compressor moldings having an elastic modulus selected to provide the desired separation force when compressed or tensile force when stretched.

Two particular containers and their parts are depicted in the figures. The first container used in the discussion above and depicted in FIG. 1 does not have a resilient separator that is configured to push against the upper and lower seal compressor moldings (although one could be included if desired). The second container illustrated in FIG. 14 utilizes the optional resilient separator and has other feature details not found in the first container.

The features discussed below for the first and second container are optional features, and any of the features discussed for parts for one of the containers can be applied to parts for the other of the containers.

First Container

Figure 12:
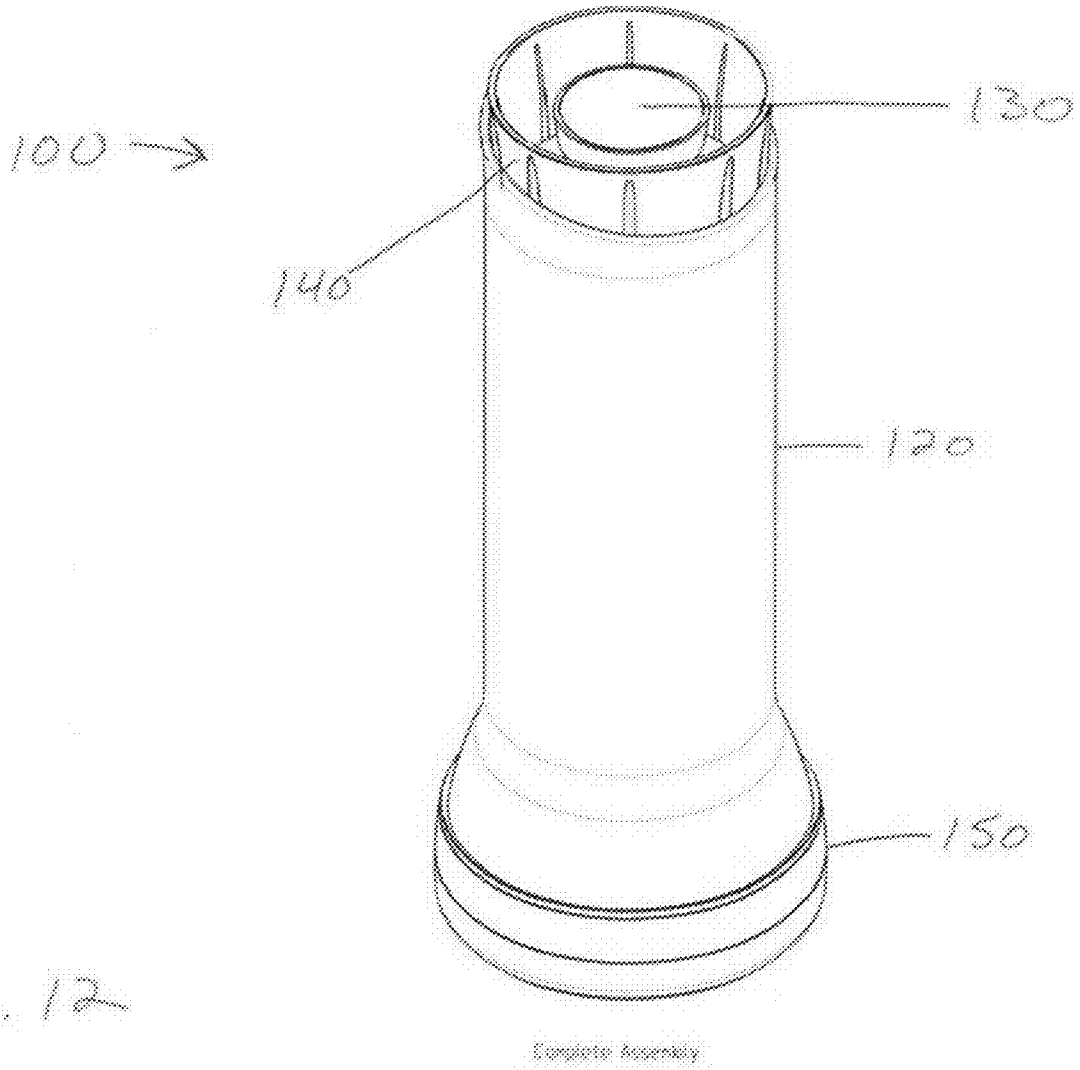
FIG. 12 is a perspective view of the first container in its assembled and almost empty state.
Figures 13A, 13B, 13C, 13D:
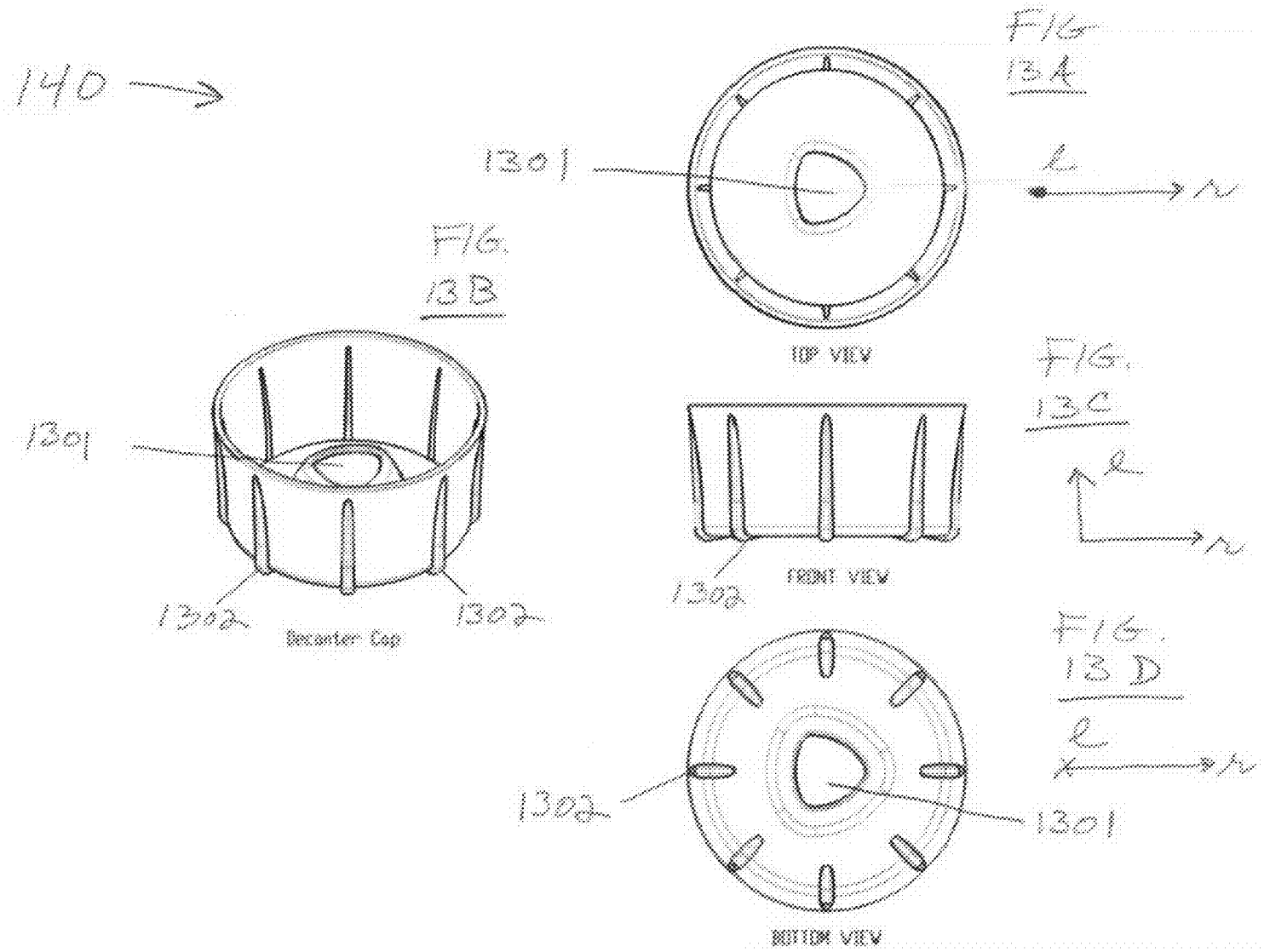

FIG. 1 illustrates the first container 100 in its disassembled state, and FIG. 12 illustrates the first container 100 in its fully assembled state, with the handle assembly 130 and cap 140 still in place within the vessel 120 and base 150 assembled to the bottom of the vessel 120. The only liquid within the vessel depicted in FIG. 12 remains in the very bottom of the vessel. Consequently, the seal assembly is positioned quite close to the bottom of the vessel but still within the cylindrical portion of the vessel in order to form an air-tight seal.

The first container's parts have a number of additional optional features not discussed above in the general discussion. The upper seal compressor molding of FIG. 6 has a form 605 that engages with a first portion 902 of the outer handle part of FIG. 11. Form 605 has a rounded, triangular depression into which the rounded triangular shape of the first portion 902 fits, while the compressor (e.g. screw 404 of FIG. 8) has teeth 806 that engage complementary teeth 903 of the inner handle piece.

The user can hold the outer handle portion stationary while turning the knob. This enables one to prevent the majority of the seal assembly from rotating while the user turns knob 901 (FIG. 9, FIG. 10) of the inner handle part to rotate screw 404 (FIG. 8). This configuration allows all of the user's movement in turning the knob to translate into compressive force applied to the seal. This configuration also enables the maximum diameter of the seal assembly in its uncompressed state to be less than the vessel's inner diameter, allowing for easy seal assembly insertion and positioning within the vessel.

Figure 13:
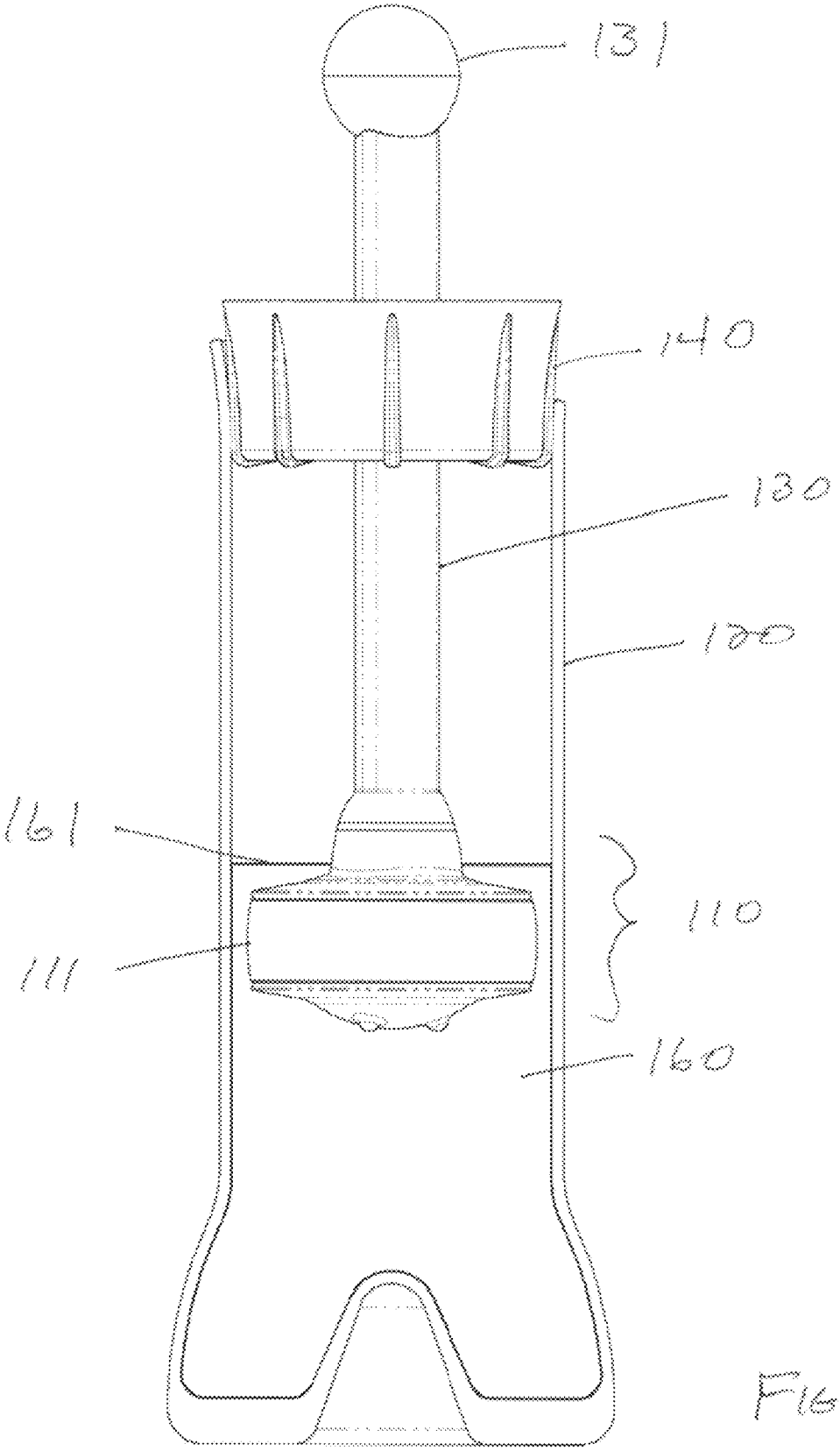
FIG. 13 depicts top (13A), perspective (13B), side (13C), and bottom (13D) views of a container's cap.

The outer handle portion can also be held stationary by optional cap 140 as illustrated in e.g. FIG. 13. Cap 140 has an opening 1301 having a complementary shape to that of the outer handle part 1100 of FIG. 11. This enables the handle assembly to slip through opening 1301 and retain the outer handle part 1100 of the handle assembly stationary when cap 140 is held stationary by either the user or by the vessel due to friction strips or ribs 1302 gripping the vessel's inner wall. The strips or ribs may be formed of a flexible polymer, for instance.

The inner handle portion 1000 of FIG. 10 can have hooks 1001 toward the end of shaft 1002 that engage with wall 1101 (FIG. 11) in the distal end of outer handle portion 1100. The hooks permit easy insertion of the inner handle part into the outer handle part to form the handle assembly while making it difficult to separate the inner handle part from the outer handle part once the handle assembly is formed.

Referring to FIGS. 5, 6, and 7, seal 401 has an optional channel 505A, 505B in each major face of the seal. Seal 401 also has an optional small rib 506A, 506B that stands above its major surface. Channel 505A receives optional annular rib 606 of the upper seal compressor part, and channel 505B receives optional annular rib 704 of lower seal compressor part 402. The sidewall of seal's rib 506A engages the wall of a second annular rib 607 of upper seal compressor part 403, and the sidewall of the seal's rib 506B engages the wall of a second annular rib 705 of the lower seal compressor part.

The upper seal compressor part and the lower seal compressor part may fit within one another in a sliding arrangement. Referring to FIG. 6 and FIG. 7, the upper seal compressor part's post 608 has a slot 609 in its sidewall. The lower seal compressor part's post 706 has a smaller diameter than opening 603 in the upper seal compressor part so that post 706 fits into opening 603. Lower seal compressor part's post 706 also has a rib 707 that fits in slot 609. This arrangement prevents the upper seal compressor part from rotating relative to the lower seal compressor part but allows them to move linearly toward or away from one another in order to compress or retract the seal.

Referring to FIG. 6 and FIG. 8, the seal compressor 404 has a nub 807 that fits within discontinuous annular channel 610 in the upper seal compressor part 403. Because the compressor is a screw with right-hand threading, the nub 807 rests against stop 611 when the seal is in its resting, uncompressed state in the seal assembly. As the user rotates compressor 404 to compress the seal against the vessel's inner wall, nub 807 turns clockwise within the channel 610 until it encounters stop 612, at which point the seal provides sufficient pressure to seal the vessel's contents from the surrounding ambient but not so much pressure that the vessel is ruptured or cracked.

Seal compressor 404 has a surface 808 that contacts the upper seal compressor part 403 at or near air channels 604 to provide the force used to move the lower seal compressor part 402 relative to the upper seal compressor part 403.

Second Container

Figure 14:
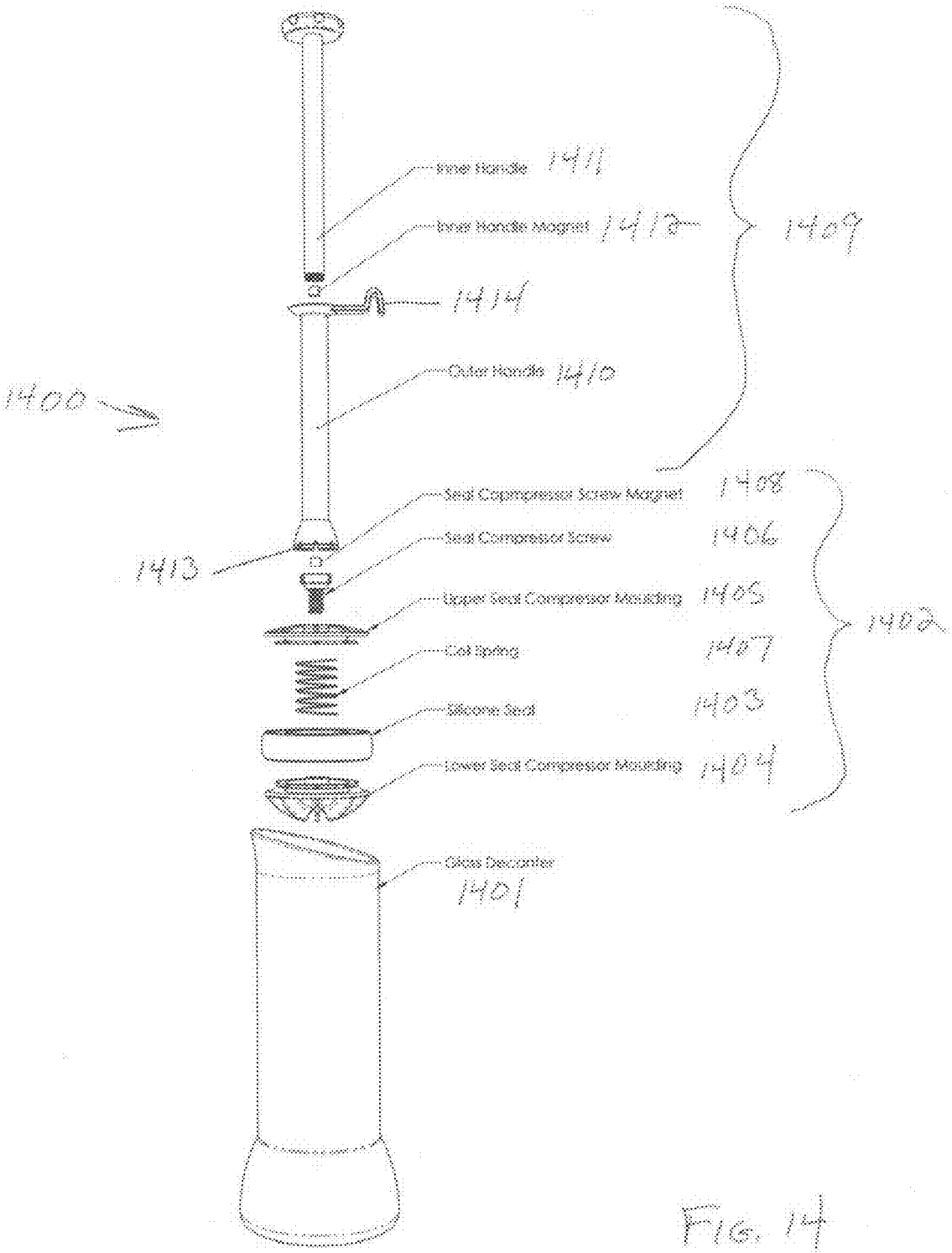
FIG. 14 is an exploded view of a second container.

FIG. 14 is an exploded view of a second container 1400. The container has similar parts to those found in the first container discussed above: vessel 1401; seal assembly 1402 comprising seal 1403, lower seal compressor molding 1404, upper seal compressor molding 140, seal compressor 1406, resilient separator 1407, and magnet 1408 embedded in seal compressor 1406; and handle assembly 1409 comprising outer handle part 1410, inner handle part 1411, and magnet 1412 embedded in inner handle part 1411.

Figure 15:
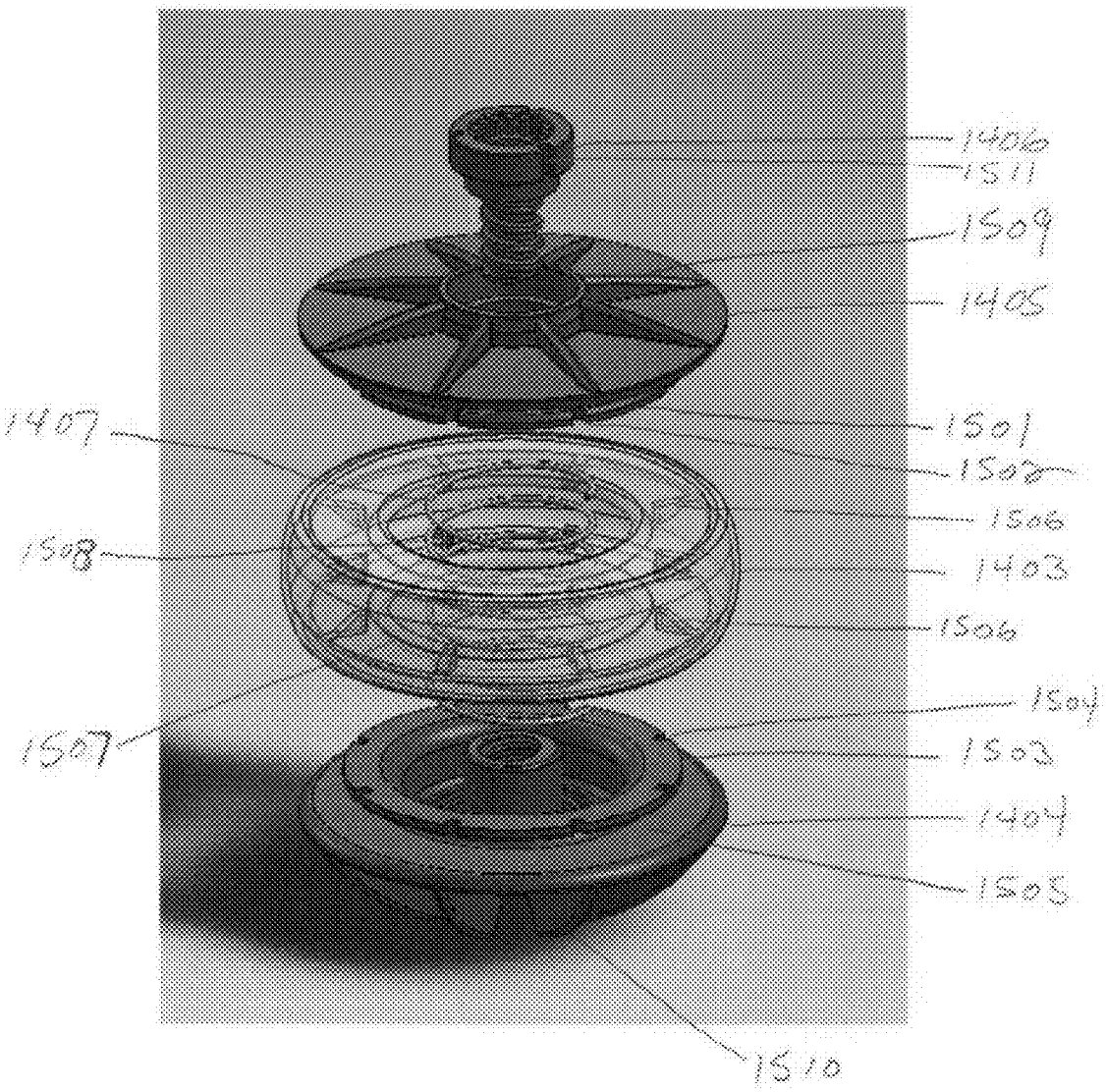
FIG. 15 is an exploded view of a seal assembly for the second container.

Referring to FIG. 15, the seal 1403 has ribs 1506 or other securing features on interior portions of the seal's faces. The seal's ribs engage with cutouts 1502, 1504 or other complementary securing features in the seal compressor moldings as discussed below.

The seal has optional mating rings 1507, 1508 in each of the seal's faces at a central opening in each face. The mating rings engage recessed portions of each seal compressor molding as discussed below.

Upper seal compressor molding 1405 may have a lip 1501 with cutouts 1502. Likewise, the lower seal compressor molding 1404 may have a lip 1503 with cutouts 1504. Each molding's lip is spaced from the molding's annular face (1505 for the lower seal compressor molding) a sufficient distance to provide a recessed body portion into which one seal face's mating ring (1506 for lower seal compressor molding, 1507 for upper seal compressor molding) is inserted. The lip's cutouts 1502, 1504 engage with ribs 1506 on an interior portion of the seal's face.

Either or each of the seal compressor moldings may have optional radial reinforcing ribs 1509, 1510 extending along the seal compressor molding's outer faces. The ribs provide sufficient body strength during sealing to maintain the body's annular face in contact with exterior portions of the seal's annular face, thereby providing an effective seal. The reinforcing ribs therefore help to assure that each body's annular face remains flat and engages uniformly with one of the seal's faces during use.

The reinforcing ribs 1510 of the lower seal compressor molding's body also optionally extend from beneath the annular face at the body's proximal end toward the body's central or vertical axis at the body's distal end. The reinforcing ribs are optionally curved to provide easier and more reliable assembly when ribs are assembled to the remainder of the lower seal compressor molding's body via compression molding. The reinforcing ribs are also optionally shaped to conform to the decanter's inner wall at the decanter's punt 230 (FIG. 16). The ribs in this instance do not contact one another at the distal end of the lower seal compressor molding's body. At least one of the ribs or all of the ribs have a suitable length and shape at their distal ends for the rib or ribs to contact the decanter's inner wall at the punt. This feature retains the seal assembly in the generally cylindrical portion of the decanter and prevents the seal assembly from dropping into the decanter's flared region when the decanter is almost empty. The seal assembly would be difficult to access in the flared region, since the compressor portion of the seal would be more difficult to access.

The lower seal compressor molding's body may also have an optional recess or platform having a diameter suitable to engage with a spring or other resilient separator 1407, as seen in FIG. 15 and FIG. 16. The recess or platform in this instance is located in an area within the lower seal compressor molding's body that faces the seal when the seal is assembled to the lower body.

The upper seal compressor molding's body may also have an optional upper recess or platform having a diameter suitable to engage with a spring or other resilient separator 1407, as seen in FIG. 15 and FIG. 16. The recess or platform in this instance is located in an area within the upper seal compressor molding's body that faces the seal when the seal is assembled to the upper body.

The upper seal compressor molding's body may also have optional radial reinforcing ribs 1509 extending from above the seal compressor molding's face and toward the body's central or vertical axis. The reinforcing ribs on each seal compressor molding help to assure that the seal compressor moldings' annular face is flat and engages uniformly with the seal's face during use.

The compressor (e.g. screw 1406 depicted in FIG. 14-16) optionally has passages 1511 in the screw's body that allow ambient air or other fluid above the seal assembly to pass into or out of the enclosed volume formed by the upper and lower seal compressor moldings' bodies and resilient seal. The figures depict three cut-outs in the screw's head that are sufficiently long to extend from the top of the screw's head and into an open area within the seal assembly. Passages such as these reduce the amount of force that a resilient separator or user must apply when loosening or tightening the seal assembly. The screw may have a left-hand thread as depicted in FIGS. 15 and 16, or the screw may have a right-hand thread as illustrated in FIG. 8.

The removable handle assembly 1409 of FIG. 14 may have an inner handle 1411 and an outer handle 1410. The outer handle in this instance has a body that is generally annular, and the handle's body has a diameter such that the outer handle is easily gripped by a person who is going to seal or unseal the container. The outer handle's body is sufficiently long that the user may continue to grip the outer handle when the seal assembly is at its lowest point in the decanter.

The outer handle's body in this instance has cutouts 1413 at the outer handle's distal end. The cutouts are spaced and sufficiently deep to engage the ribs 1509 (FIG. 15) on the upper seal compressor molding's body.

The outer handle optionally has a hook 1414 at the outer handle's proximal end. The hook has an opening sufficiently large to allow the user to hang the handle assembly on an edge of the glass vessel, so that the handle assembly is conveniently accessible for use.

The body of the inner handle 1411 in this instance is generally annular or cylindrical and has a diameter such that the inner handle fits within the opening defined by the outer handle's annular body. The distal end of the inner handle's body has ribs or cut-outs that engage with complementary cut-outs or ribs present on the seal compressor molding's body, similar to the handle assembly of the first container.

The distal end of the inner handle optionally has a magnet or is itself magnetic, so that the distal end of the inner handle is attracted to the compressor because of the compressor's magnet.

The proximal end of the inner handle's body has a knob. The knob is optionally knurled to enable the user to better grip and turn the knob.

Container 2 in Use

Starting with an empty decanter, the user places a beverage to be preserved within the decanter's generally enclosed volume.

Starting with a seal assembly that is adjusted so that the seal is not in its expanded state, the user may connect the seal assembly to the handle assembly before inserting the seal assembly within the decanter's enclosed volume if the compressor and the handle assembly's inner handle are e.g. magnetic or if they connect mechanically.

The inner handle's ribs at the distal end of the inner handle consequently engage cutouts in the compressor so that any torque imparted to the knob is imparted to the compressor.

The outer handle's cutouts also engage the upper seal compressor molding's ribs. Any torque applied to the outer handle is therefore imparted to the upper seal compressor molding.

The user may conveniently insert the connected assembly into the decanter's volume until the seal assembly begins to push liquid up the seal's sidewall. The user may use one hand to grip the outer handle and hold the outer handle stationary, and the user may use the other hand to turn the knob of the inner handle to impart a torque to the compressor.

The user turns the knob to move the faces of the upper and lower seal compressor moldings closer to one another, thereby reducing the distance between the two faces. The seal compressor moldings' faces push on the outer portions of the seal's upper and lower faces, thereby squeezing the seal and the resilient separator.

The action of squeezing the seal's two faces causes the seal's sidewall to bulge outwardly (expanding the seal's diameter), so that the exterior portion of the seal's sidewall presses against the decanter's interior wall to prevent air from entering past the seal. The seal deforms and bulges more in sidewall portions not already touching the decanter's interior wall as the seal compressor molding faces move closer to one another, pressing more of the seal's sidewall against the decanter and pressing with greater force. The user may then separate the handle assembly from the seal assembly, remove any liquid not within the sealed volume, and then hang the handle assembly on the exterior wall of the decanter so that the handle is readily available for next use.

The particular screw illustrated in the figures has a left-hand thread, so that the seal's sidewall engages the decanter when the screw is turned counter-clockwise. Consequently, in this instance, the user turns the knob counter-clockwise to seal the beverage within the decanter, and the user turns the knob clockwise to release the seal and access the decanter's contents.

A user releases the seal assembly from the decanter's inner wall by placing the handle assembly onto the seal assembly so that the cutouts on the distal end of the outer handle mate with ribs on the upper seal compressor molding and so that the ribs on the distal end of the inner handle engage cutouts in the compressor. The user holds the outer handle stationary while turning the knob to move the upper and lower seal compressor moldings' faces away from one another. The energy stored in the resilient separator when the seal was compressed helps to push the two seal compressor moldings away from one another. The user can subsequently retract the seal assembly by lifting the handle assembly when the handle assembly and the seal assembly are e.g. magnetic and consequently joined to one another by magnetism.

Third Container

Figure 17:
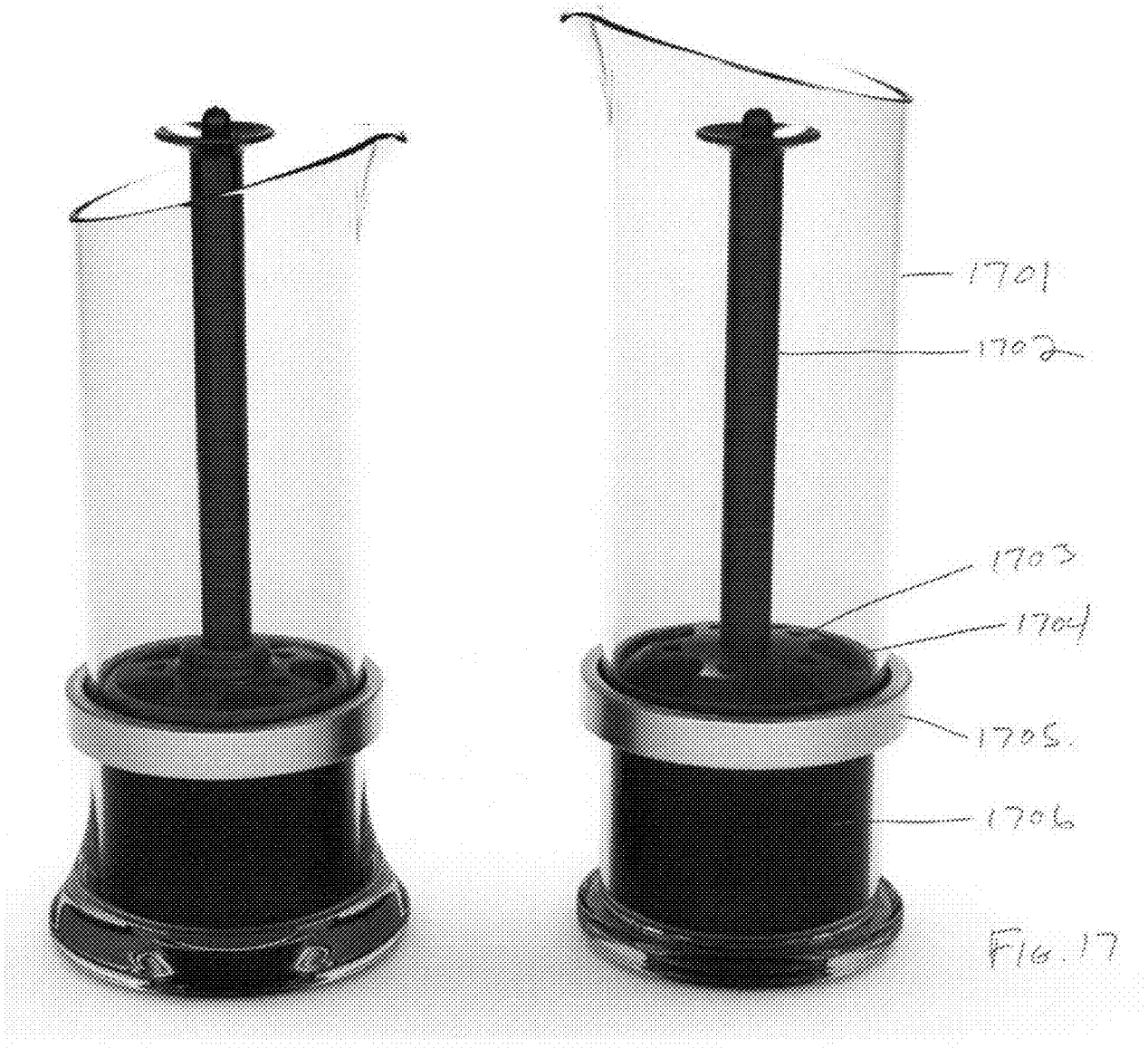
FIG. 17 is an illustration of a third container.

A third container is illustrated in FIG. 17. This container illustrates vessel 1701, handle 1702, upper seal compressor housing 1703, magnetic seal 1704 compressed against the inner wall of vessel 1701, and magnetic ring 1705 on the vessel's outer wall. Magnetic ring 1705 attracts seal 1704 toward magnetic ring 1705, thereby forming a seal and preventing ambient air from entering the wine 1706 beneath the seal assembly.

Consequently, what is disclosed by way of example and not by way of limitation is:

1. A container comprising
   a. a vessel having an inner wall that is cylindrical along at least a majority of the vessel's length, and
   b. a seal assembly that is removable from the vessel
   c. wherein the seal assembly comprises
      i. a resilient seal having a first major face, a second major face, and an edge extending for a length measured from the first major face to the second major face
      ii. a seal housing comprising
         1. a first seal compressor platform on the first major face of the seal and
         2. a second seal compressor platform on the second major face of the seal, and
      iii. a seal compressor that expands a diameter of the seal so that the edge of the seal engages an inner wall of the vessel to form a volume within the vessel that is isolated from an ambient to the vessel.

2. A container according to paragraph 1 wherein the seal has a "C" or "U" shape for a seal cut in half along said length.

3. A container according to paragraph 1 or paragraph 2 wherein the seal is hollow.

4. A container according to any one of paragraphs 1-3 wherein the seal comprises silicone rubber.

5. A container according to paragraph 4 wherein the seal consists essentially of silicone rubber.

6. A container according to any one of paragraphs 1-5 wherein the first seal compressor platform has a passage to provide fluid communication between the ambient and an interior portion of the seal.

7. A container according to any one of paragraphs 1-6 wherein the first seal compressor platform has a radial channel that engages with a radial rib of the seal.

8. A container according to any one of paragraphs 1-7 wherein the second seal compressor platform has a radial channel that engages with a radial rib of the seal.

9. A container according to any paragraph above wherein the first seal compressor platform has an annular rib that engages with an annular channel of the seal.

10. A container according to any paragraph above wherein the second seal compressor platform has an annular rib that engages with an annular channel of the seal.

11. A container according to any paragraph above wherein the first seal compressor platform engages the second seal compressor platform to prevent rotation of one relative to the other of the first and second compressor platforms.

12. A container according to any paragraph above wherein the second seal compressor platform has a portion that engages a punt of the vessel.

13. A container according to paragraph 12 wherein the portion comprises a plurality of nubs that rest upon the punt.

14. A container according to paragraph 12 wherein the portion comprises a plurality of ribs that rest upon the punt.

15. A container according to paragraph 1 wherein the seal compressor comprises a screw that engages with the handle and changes a distance between the first seal compressor platform and the second seal compressor platform.

16. A container according to paragraph 15 wherein the screw has a nub.

17. A container according to paragraph 16 wherein one of the first seal compressor platform and the second seal compressor platform has a first stop that engages the nub to prevent further compression of the seal.

18. A container according to paragraph 16 or paragraph 17 wherein one of the first seal compressor platform and the second seal compressor platform has a second stop that engages the nub to prevent further retraction of the seal.

19. A container according to any one of paragraphs 1-18 wherein the container further comprises a handle that engages the seal assembly to remove the seal assembly from the vessel.

20. A container according to paragraph 19 wherein the handle comprises an inner handle portion and an outer handle portion, and wherein the inner handle portion is rotatable relative to the outer handle portion.

21. A container according to paragraph 20 wherein the inner handle portion engages the seal compressor to actuate the seal compressor.

22. A container according to paragraph 21 wherein the inner handle portion has a shape that engages a complementary shape on the seal compressor so that the seal compressor moves as the inner handle portion is moved.

23. A container according to paragraph 21 or paragraph 22 wherein the outer handle portion engages a rib on the first seal compressor platform.

24. A container according to paragraph 21 or paragraph 22 wherein the container further comprises a cap, and the outer handle portion engages the cap to prevent rotation of the outer handle portion relative to the cap.

25. A container according to paragraph 24 wherein the outer handle portion has a shape that engages a complementary shape in the cap.

26. A container according to paragraph 24 or paragraph 25 wherein the cap engages the inner wall of the vessel with sufficient force that the cap does not rotate when the inner handle portion of the handle is rotated.

27. A container according to paragraph 26 wherein the cap has vertical strips or ribs formed of a flexible polymer having a sufficient coefficient of friction to prevent the cap from rotating when the inner handle portion is rotated.

28. A container according to paragraph 1 wherein the seal compressor comprises a ring along an outer wall of the vessel, and wherein at least one of the seal compressor and the seal has a portion that is magnetic to compress the seal against the inner wall of the vessel with magnetism.

29. A container according to any of paragraphs 19-28 wherein at least one of the handle and the seal assembly has a magnet so that the handle and the seal assembly magnetically attract and engage.

30. A container according to any paragraph above wherein at least a portion of the vessel is transparent.

31. A container according to any paragraph above wherein the container further comprises a base that engages a lower portion of the vessel.

32. A container according to any paragraph above wherein the upper portion of the vessel comprises a pour lip.

33. A container according to any paragraph above wherein the seal assembly has a maximum diameter that is less than a diameter of the vessel's inner wall when the seal is in its uncompressed state.

34. A container according to any paragraph above wherein the vessel is a glass vessel.

35. A seal assembly as set forth in any one of paragraphs 1-33.

36. A handle assembly as set forth in any one of paragraphs 1-33, alone or in combination with a seal assembly of paragraph 35.

37. A method of preserving a fluid from a contaminant in an ambient comprising a. positioning a seal assembly having an uncompressed seal at or slightly below a surface of the fluid residing within a vessel b. compressing an edge of the seal sufficiently against an inner surface of the vessel to isolate the fluid from the ambient while retaining the seal between an upper seal compressor platform and a lower seal compressor platform of the seal assembly.

38. A method of preserving a fluid from a contaminant in an ambient comprising a. applying a pressure to a seal of a seal assembly, where the seal has major faces and an edge extending between the major faces, and where the pressure is applied to the major faces;

b. expanding the seal primarily in a direction normal to the major faces in response to said pressure and with sufficient force to compress the edge of the seal against an inner wall of a vessel.

39. A method according to paragraph 37 or paragraph 38 wherein the method further comprises venting the interior of the seal assembly to the ambient during said compressing to maintain a pressure within the seal assembly at ambient pressure.

40. A method according to any one of paragraphs 37-39 wherein the seal's edge is compressed against the vessel's inner surface by decreasing a distance between the upper seal compressor platform and the lower seal compressor platform.

41. A method according to paragraph 40 wherein the seal is mechanically compressed by translating a rotational movement into a linear movement that decreases said distance.

42. A method according to paragraph 41 wherein the seal compression is limited by mechanically limiting the rotational movement of a screw that decreases the distance between the upper seal compressor platform and the lower seal compressor platform.

43. A method according to paragraph 41 or paragraph 42, wherein the method further comprises releasing the seal compression by rotational movement in an opposite direction and wherein the amount of possible rotational movement is limited mechanically.

44. A method according to any one of paragraphs 37-43 wherein the seal is compressed while preventing the upper seal compressor platform from rotating relative to the lower seal compressor platform.

45. A method according to paragraph 37 wherein the seal's edge is compressed against the vessel's inner surface by magnetically attracting the seal's edge to the inner surface of the vessel.

46. A method according to paragraph 45 wherein the magnetic attraction is provided by placing a ring having magnetic susceptibility along an outer surface of the vessel and adjacent to the seal's edge.

47. A method according to any one of paragraphs 37-46 wherein the seal is positioned along a longitudinal direction of the vessel by way of a handle removable from the seal assembly.

48. A method according to paragraph 47 wherein the method further comprises retaining the handle to the seal assembly magnetically.

49. A method according to any one of paragraphs 37-48 above wherein the fluid is an oxygen-sensitive liquid.

50. A method according to paragraph 49 wherein the liquid is wine.

51. A method according to any one of paragraphs 37-50 wherein the vessel is a glass vessel.

52. A method of making a seal assembly for a vessel comprising a. sandwiching a seal having major faces between a first seal compressor platform and a second seal compressor platform such that the major faces contact the first seal compressor platform and the second seal compressor platform, b. assembling the seal, the first seal compressor platform, and the second seal compressor platform to prevent radial movement and permit only longitudinal movement of the first seal compressor platform relative to the second seal compressor platform in the assembled seal assembly.

53. A method according to paragraph 52 wherein the step of assembling comprises inserting a longitudinal post of one of the first seal compressor platform and the second seal compressor platform into a recess in the other of the first seal compressor platform and the second seal compressor platform.

54. A method according to paragraph 52 or paragraph 53 wherein the seal is a hollow seal.

55. A method according to any one of paragraphs 52-54 wherein the seal has a "C" or "U" shape for a seal cut in half along its length.

56. A method according to any one of paragraphs 52-55 wherein the step of assembling further comprises providing a stop that prevents rotation of the first seal compressor platform relative to the second seal compressor platform.

57. A method according to any one of paragraphs 52-56 and further comprising assembling a compressor to the first seal compressor platform and the second seal compressor platform that moves the first seal compressor platform longitudinally relative to the second seal compressor platform.

58. A method according to paragraph 57 wherein the compressor comprises a screw configured to be movable in normal use by a user of the seal assembly.

59. A method according to paragraph 57 or paragraph 58 and further comprising providing a stop to prevent the compressor from moving a sufficient amount to over-expand the seal.

60. A method according to any one of paragraphs 57-59 and further comprising providing a stop to prevent the compressor from moving a sufficient amount to disengage the compressor from one of the first and second seal compressor platforms.

61. A method according to any of paragraphs 37-60 wherein the seal comprises silicone.

62. A method according to paragraph 61 wherein the seal consists essentially of silicone.

63. A method according to any of paragraphs 37-62 wherein the vessel is a glass vessel.

Other configurations, methods, and embodiments are apparent to those of ordinary skill from the discussion herein, and nothing in the foregoing discussion is to be construed as limiting of the scope of the following claims. Consequently, the claims are to be afforded a broad interpretation consistent with the discussion herein.

What is claimed is:

1. A container comprising a. a vessel having an inner wall that is cylindrical along at least a majority of the vessel's length, and b. a seal assembly that is removable from the vessel c. wherein the seal assembly comprises i. a resilient seal having a first major face, a second major face, and an edge extending for a length measured from the first major face to the second major face, ii. a seal housing comprising 1. a first seal compressor platform on the first major face of the seal and 2. a second seal compressor platform on the second major face of the seal, and iii. a seal compressor that expands a diameter of the seal so that the edge of the seal engages an inner wall of the vessel to form a volume within the vessel that is isolated from an ambient to the vessel, d. where the seal has a "C" or "U" shape for the seal cut in half along said length of said seal e. wherein the seal is hollow, f. wherein the seal compressor comprises a screw that engages with a handle and changes a distance between the first seal compressor platform and the second seal compressor platform, g. wherein the handle is configured to engage the seal assembly to remove the seal assembly from the vessel, h. wherein the handle comprises an inner handle portion and an outer handle portion, wherein the inner handle portion is rotatable relative to the outer handle portion, and i. wherein the seal assembly has a maximum diameter that is less than a diameter of the vessel's inner wall when the seal is in an uncompressed state such that the seal assembly is positionable along the inner wall of the vessel at any position along the vessel's cylindrical length.

2. A container according to claim 1 wherein the seal comprises silicone rubber.

3. A container according to claim 1 wherein the first seal compressor platform has a passage configured to provide fluid communication between the ambient and an interior portion of the seal.

4. A container according to claim 1 wherein the first seal compressor platform has an annular rib that engages with an annular channel in a surface of the seal.

5. A container according to claim 4 wherein the second seal compressor platform has an annular rib that engages with an annular channel of the seal.

6. A container according to claim 1 wherein the first seal compressor platform engages the second seal compressor platform to prevent rotation of one relative to the other of the first and second compressor platforms.

7. A container according to claim 1 wherein the second seal compressor platform has a portion that has a shape that engages with a shape of a punt of the vessel.

8. A container according to claim 7 wherein said portion comprises a plurality of nubs that rest upon the punt.

9. A container according to claim 7 wherein said portion comprises a plurality of ribs that rest upon the punt.

10. A container according to claim 1 wherein the screw has a nub that engages one or more stops to prevent over-rotation of the screw.

11. A container according to claim 10 wherein one of the first seal compressor platform and the second seal compressor platform has a first stop that engages the nub of the screw to prevent further compression of the seal.

12. A container according to claim 11 wherein one of the first seal compressor platform and the second seal compressor platform has a second stop that engages the nub to prevent further retraction of the seal.

13. A container according to claim 10 wherein the screw has a head having a top, a bottom, and an outer side, and the nub is on the outer side of the head of the screw.

14. A container according to claim 10 wherein said one or more stops are within a channel within a face of one of the first and second seal compressor platforms.

15. A container according to claim 1 wherein at least one of the handle and the seal assembly has a magnet so that the handle and the seal assembly magnetically attract and engage.

16. A container according to claim 1 wherein the inner handle portion engages the seal compressor to actuate the seal compressor.

17. A container according to claim 16 wherein the inner handle portion has a shape that engages a complementary shape on the seal compressor so that the seal compressor moves as the inner handle portion is moved.

18. A container according to claim 16 wherein the outer handle portion engages a rib on the first seal compressor platform.

19. A container according to claim 16 wherein the container further comprises a cap, and the outer handle portion engages the cap to prevent rotation of the outer handle portion relative to the cap.

20. A container according to claim 19 wherein the outer handle portion has a shape that engages a complementary shape in the cap.

21. A container according to claim 19 wherein the cap engages the inner wall of the vessel with sufficient force that the cap does not rotate when the inner handle portion of the handle is rotated.

22. A container according to claim 21 wherein the cap has strips or ribs formed of a flexible polymer having a sufficient coefficient of friction to prevent the cap from rotating when the inner handle portion is rotated.

23. A container according to claim 1 wherein at least one of the first and second seal compressor platforms has an engaging rib that engages with a slot in the other of the first and second seal compressor platforms to prevent rotation of the first seal compressor platform relative to the second seal compressor platform.

* * * * *